US007493705B2

(12) United States Patent
Gomi

(10) Patent No.: US 7,493,705 B2
(45) **Date of Patent: *Feb. 24, 2009**

(54) REDUCED-PRESSURE DRYING APPARATUS

(75) Inventor: Kazuhiro Gomi, Chino (JP)

(73) Assignee: Seiko Epson Corporation (JP)

( * ) Notice: Subject to any disclaimer, the term of this patent is extended or adjusted under 35 U.S.C. 154(b) by 275 days.

This patent is subject to a terminal disclaimer.

(21) Appl. No.: 11/458,500

(22) Filed: Jul. 19, 2006

(65) Prior Publication Data

US 2007/0022626 A1 Feb. 1, 2007

(30) Foreign Application Priority Data

Aug. 1, 2005 (JP) ..... 2005-222528

(51) Int. Cl.
*F26B 3/00* (2006.01)

(52) U.S. Cl. ..... 34/78

(58) Field of Classification Search ..... 34/406, 34/77, 78, 80

See application file for complete search history.

(56) References Cited

U.S. PATENT DOCUMENTS 6,394,110 B2 * 5/2002 Kamikawa et al. ..... 134/61

FOREIGN PATENT DOCUMENTS

| | | |
|---|---|---|
| JP | 63-222433 | 9/1988 |
| JP | 2000-100890 | 4/2000 |
| JP | 2000-182932 | 6/2000 |
| JP | 2001-319852 | 11/2001 |
| JP | 2002-313709 | 10/2002 |
| JP | 2003-168643 | 6/2003 |

* cited by examiner

*Primary Examiner*—S. Gravini
(74) *Attorney, Agent, or Firm*—Harness, Dickey & Pierce, P.L.C.

(57) ABSTRACT

A reduced-pressure drying apparatus for drying a solvent in a liquid under a reduced pressure by evaporation of the solvent, includes a chamber including a first chamber and a second chamber, the first chamber accommodating work to which a liquid containing a film forming material is applied, the second chamber being coupled to the first chamber through a communicating part; a depressurizing unit depressurizing at least the second chamber; a communicating valve opening and closing the communicating part; and a control unit controlling a reduced pressure state at least of the second chamber by driving the depressurizing unit, the control unit also controlling an opening and closing state of the communicating part by driving the communicating valve.

12 Claims, 8 Drawing Sheets

REDUCED-PRESSURE DRYING APPARATUS

BACKGROUND OF THE INVENTION

1. Technical Field

The present invention relates to a reduced-pressure drying apparatus that is used when work to which some liquid is applied is dried under reduced pressure so as to form a film on the surface of the work.

2. Related Art

A reduced-pressure drying apparatus in which a solvent component in a liquid is vaporized and dried out is used for forming a film on a wafer-like substrate such as a semiconductor substrate by applying the liquid containing a film formation material. JP-A-2002-313709 is an example of related art. The example proposed the reduced-pressure drying apparatus in which a substrate to which photoresist is applied is placed in a reduced-pressure chamber. A rectifying plate is provided so as to oppose the substrate and a venting hole is provided on the peripheral of the rectifying plate.

The above-mentioned reduced-pressure drying apparatus exhausts from the upper part of the chamber and this forms a unidirectional air flow that starts from around the peripheral of the wafer-like substrate and streams through the venting hole of the rectifying plate to an exhaust outlet. Accordingly, the velocity of the air flow running between the rectifying plate and the substrate becomes uniform in the substrate plane. Therefore, the thickness of the film is made even in the substrate plane and it is possible to form the film with a uniform thickness on the substrate.

As described above, many electronic devices including semiconductors have a manufacturing process in which a liquid containing a functional material is applied to work such as a wafer in order to form a film made of the functional liquid on the surface of the work.

However, in a drying process in which the liquid is dried to form the film, it is very difficult to dry the liquid so as to form the film having a completely uniform thickness throughout the film when it is under the formation on the surface of the work or after the formation, and even with the above-described reduced-pressure drying apparatus. This is because many kinds of liquid can be used and a saturated vapor pressure and rheological properties (viscosity, elasticity, plasticity, thixotropy and the like) vary according to each kind of the liquid. In addition, behaviors of the liquid such as an evaporation rate during the drying process also vary according to volumes and a surface area ratio of a solute and a solvent contained in the liquid.

Even when the above-described hitherto known reduced-pressure drying apparatus has the rectifying plate in order to control the air flow of a solvent which evaporated from the liquid under a reduced-pressure to have a uniform velocity in a constant direction, a movement (convection flow) of the liquid is generated in the drying process and the uniformity of the film thickness is deteriorated by surface tension. Furthermore, vapor concentration (or pressure) distribution differs from a center part to a peripheral part, resulting in the film thickness in-plane distribution caused by a difference in drying rate. Moreover, if the drying apparatus has to be optimally redesigned according to kinds of the liquid material or a configuration of the work to which the liquid is applied, the versatility of the apparatus cannot be secured.

SUMMARY

An advantage of the present invention is to provide a reduced-pressure drying apparatus in which the evaporation rate of a solvent contained in an applied liquid can be optimized in a drying process according a type of the liquid and the drying process under a reduced pressure can be carried out in an uniform distribution of the vapor pressure of the solvent.

According to an aspect of the invention, a reduced-pressure drying apparatus for drying a solvent in a liquid under a reduced pressure by evaporation of the solvent, includes a chamber including a first chamber and a second chamber, the first chamber accommodating work to which a liquid containing a film forming material is applied, the second chamber being coupled to the first chamber through a communicating part; a depressurizing unit depressurizing at least the second chamber; a communicating valve opening and closing the communicating part; and a control unit controlling a reduced pressure state at least of the second chamber by driving the depressurizing unit, the control unit also controlling an opening and closing state of the communicating part by driving the communicating valve.

The rheological properties of the liquid applied to the work differ depending on the kinds of the liquid. In some kinds of the liquid, the behavior of the liquid is affected in the course of the drying process when the vapor pressure and the evaporation rate sharply change due to depressurization. This results in unevenness in the thickness of the dried film. In order to dry the liquid such that the formed film after the drying is flat and the unevenness in the film thickness on the work surface becomes less, it is important to evaporate the solvent while preventing the liquid from flowing and being deformed in the course of drying. According to the aspect of the invention, the chamber is divided into the first chamber that accommodates the work and the second chamber whose pressure can be reduced by the depressurizing unit. The control unit can close the first chamber air-tightly and can communicate the first chamber with the second chamber by driving the communicating valve. Accordingly, if the first chamber is separated from the second chamber and air-tightly closed after the first chamber and the communicating second chamber are depressurized, the evaporation of the solvent is promoted in the first chamber, creating a pressure difference between the first chamber and the second chamber. Consequently, the evaporation rate of the solvent in the applied liquid can be made moderate corresponding to the reduced pressure state of the first chamber, and this can suppress the flow of the liquid. If the first chamber is made communicate with the second chamber after the pressure in the first room rises as the evaporation of the solvent progresses, the vapor of the solvent can be diffused into the second chamber because there is a pressure difference between the first chamber and the second chamber. The depressurizing unit then exhausts the solvent vapor diffused in the second chamber. In this way, the drying of the liquid is performed. The pressure in the first chamber will not be affected by the exhaustion of the depressurizing unit since the first chamber is air-tightly closed. Therefore, the unevenness in the evaporation rate of the solvent caused by the exhaustion flow can be reduced. This means that the evaporation rate of the solvent in the applied liquid can be optimized if the reduced pressure state of the first chamber is decided depending on the kinds of the liquid. Consequently, it is possible to provide the reduced pressure drying apparatus with which the depressurizing and drying can be carried out while keeping the vapor pressure distribution of the solvent substantially uniform. It is also possible to set appropriate depressurizing conditions according to the kinds of the liquid. This gives versatility to the reduced pressure drying apparatus.

In this case, the reduced-pressure drying apparatus may further include a pressure gauge measuring a reduced pressure state at least of the first chamber. The control unit drives the communicating valve to communicate the first chamber with the second chamber, and drives the depressurizing unit so that the first chamber and the second chamber are depressurized till a pressure value detected by the pressure gauge reaches a prescribed operational pressure. The control unit then drives the communicating valve to close the communicating part so that the first chamber is air-tightly closed. The control unit drives the communicating valve again to communicate the first chamber with the second chamber if the pressure value of the first chamber detected by the pressure gauge reaches a predetermined pressure value, and the control unit then drives the depressurizing unit to exhaust vapor of the solvent that is diffused in the first chamber and the second chamber.

The control unit firstly communicates the first chamber with the second chamber. After the depressurizing the chamber till the pressure value detected by the pressure gauge reaches a prescribed operational pressure, the first chamber is air-tightly closed. In this way, the solvent in the liquid which is applied to the work can be vaporized under the prescribed operational pressure in the first chamber without being affected by the exhaustion of the depressurizing unit. The first chamber is coupled again to the second chamber when the pressure gauge finds the pressure in the first chamber reach a predetermined pressure value. The vapor of the solvent flows and diffuses into the second chamber from the first chamber where the pressure becomes the predetermined pressure value. The control unit then makes the depressurizing unit exhaust the diffused vapor of the solvent. In this way, the liquid is dried under a reduced pressure. Since the first chamber is closed at the prescribed operational pressure, the evaporation rate of the solvent in the applied liquid can be controlled corresponding to the prescribed operational pressure. In addition, the unevenness in the evaporation rate of the solvent caused by the exhaustion flow can be reduced since it is not affected by the exhaustion of the depressurizing unit. This means that the evaporation rate of the solvent in the applied liquid can be optimized if the prescribed operational pressure in the first chamber is decided depending on the kinds of the liquid. Consequently, it is possible to provide the reduced pressure drying apparatus with which the depressurizing and drying can be carried out while keeping the vapor pressure distribution of the solvent substantially uniform.

In this case, the predetermined pressure value may be a sum of the prescribed operational pressure and a vapor pressure at which a certain amount of the solvent is evaporated in the air-tightly closed first chamber, and the control unit make the depressurizing unit exhaust the vapor of the solvent diffused in the first chamber and the second chamber under a pressure whose value is larger than the predetermined pressure value.

The predetermined pressure value is the sum of the prescribed operational pressure and a vapor pressure at which a certain amount of the solvent is evaporated in the air-tightly closed first chamber, and the control unit exhausts the vapor under a pressure whose value is larger than the predetermined pressure value. Accordingly, it can be prevented that the solvent evaporates more than the certain amount which evaporated in the first chamber, during the exhaustion by the depressurizing unit. Therefore, the evaporation amount of the solvent in the closed first chamber can be controlled. This means that the ratio between the solvent and the solute can be estimated. If the evaporation amount of the solvent is appropriately decided in advance, it is possible to provide the reduced pressure drying apparatus in which the drying under a reduced pressure can be more optimally performed. Here, the certain amount of the solvent means either the full amount of the solvent contained in the liquid or a divided amount of the solvent depending on the kids of the liquid.

In this case, a viscosity of the liquid is increased as the solvent evaporates from the liquid. And the prescribed operational pressure may be a pressure at which the viscosity of the liquid reaches just before a degree where the viscosity will affect a shape of the film. The predetermined pressure value may be the sum of the prescribed operational pressure and a saturated vapor pressure of the solvent evaporated in the air-tightly closed first chamber.

The prescribed operational pressure is set to a pressure at which the viscosity of the liquid reaches just before a degree where the viscosity will affect a shape of the film, and the predetermined pressure value is set to the sum of the prescribed operational pressure and a saturated vapor pressure of the solvent evaporated in the air-tightly closed first chamber. When the solvent evaporation progresses and the pressure in the first chamber reaches substantially the saturated vapor pressure, the system of the liquid and the vapor becomes close to the equilibrium condition in which the viscosity of the vapor could affect the shape of the film. This means that the first chamber is kept air-tightly closed till the evaporation rate of the solvent becomes considerably slow compared with the initial evaporation rate. Accordingly, the drying under a reduced pressure can be performed in a condition where the film shape will not be affected by the flow of the liquid since the evaporation rate will not change rapidly. Moreover, the distribution of the solvent vapor pressure on the surface of the work can be made uniform since the system comes close to the equilibrium condition. Consequently, it is possible to provide the reduced pressure drying apparatus with which the formed film after the drying is flat and the unevenness in the film thickness on the work surface becomes less.

It is preferable that the control unit make the depressurizing unit depressurize the second chamber that is separated from the first chamber to a pressure lower than the prescribed operational pressure before the control unit drives the communicating valve to communicate the first chamber with the second chamber and the vapor of the solvent diffused in the chamber is exhausted by the depressurizing unit.

Since the pressure in the second chamber separated from the first chamber is reduced to a pressure lower than the prescribed operational pressure before the vapor of the solvent diffused in the first and second chambers is exhausted by the depressurizing unit, the vapor of the solvent evaporated in the first chamber is easily diffused into the second chamber where the presser is lower that the first chamber.

It is also preferable that the control unit repeat control operation that starts from depressurization of the first chamber and the second chamber by the depressurizing unit and ends at exhaustion of the solvent vapor diffused in the first chamber and the second chamber.

The amount of the liquid applied to the work and the amount of the solvent contained in the liquid differ depending on the property of the film (thickness, area, density and the like) which is going to be formed on the work. According to the above-mentioned way, the control unit can repeat the above-mentioned control operation so that the drying under a reduced pressure can be securely performed by repeating the control operation according to the amount of the applied liquid or the amount of the solvent. If the control operation of the drying is repeated, the solvent vapor is firstly diffused into the second chamber from the first chamber, the first chamber is then closed air-tightly, and then the diffused vapor is discharged by the depressurizing unit. In this way, the fluctuation in the vapor pressure of the solvent remaining around the surface of the liquid can be repressed by closing the first chamber. Consequently, it is possible to reduce the effect of the exhaustion by the depressurizing unit on the behavior of the liquid.

Moreover, the reduced-pressure drying apparatus may include a pressure gauge measuring a reduced pressure state at least of the second chamber. The control unit may drive the communicating valve to close the first chamber air-tightly, and subsequently drive the depressurizing unit so that the air-tightly closed second chamber is depressurized till a pressure value detected by the pressure gauge reaches the prescribed operational pressure. The control unit then drives the communicating valve and releases the communicating part so as to communicate the first chamber with the second chamber, and the control unit makes the depressurizing unit exhaust vapor of the solvent diffused in the first chamber and the second chamber.

In case that the vapor pressure of the solvent is high in some kinds of the liquid, a considerable amount of the solvent can be evaporated before reaching the prescribed operational pressure when the work to which the liquid is applied is placed in the chamber and the chamber is depressurized. In this case, it is difficult to control the flow of the liquid in the course of the depressurization. However, according to the above mentioned aspect, after the control unit closes the first chamber air-tightly, the control unit drives the depressurizing unit so that the air-tightly closed second chamber is depressurized till a pressure value detected by the pressure gauge reaches the prescribed operational pressure. After that, the control unit drives the communicating valve to release the communicating part so as to communicate the first chamber with the second chamber. Accordingly, the first chamber, where the work is accommodated under the atmospheric pressure at which the solvent will not evaporate, can be rapidly depressurized by coupling the first chamber with the second chamber where the pressure reaches at least the prescribed operational pressure. In this way, it is possible to provide the reduced pressure drying apparatus in which the dying under a reduced pressure can be promptly carried out by reducing the movement of the liquid flow generated in the course of the process.

Moreover, the prescribed operational pressure may be higher than a vapor pressure of the solvent in the liquid. The evaporation of the solvent from the liquid starts under a reduced pressure even before the pressure is reduced to the vapor pressure of the solvent because some molecule of the solvent have a high kinetic energy enough to evaporate. In this case, the prescribed operational pressure is set to the value which is higher than the vapor pressure of the solvent in the liquid so that the solvent will not be suddenly vaporized and will not bump. Therefore, it is possible to promote the evaporation of the solvent while repressing the liquid flow generated by the bumping.

It is preferable that a capacity of the second chamber being larger than a capacity of the first chamber. If the capacity of the second chamber is larger than the capacity of the first chamber, the vapor of the solvent evaporated from the liquid applied to the work in the first chamber can be easily diffused into the second room by coupling the first chamber with the second chamber since the pressure in the first chamber is higher than that of the second chamber due to the evaporation of the solvent.

Furthermore, the reduced-pressure drying apparatus may include an introducing valve introducing an inactive gas at least into the first chamber from outside. The control unit drives the introducing valve to introduce the inactive gas into the first chamber in the case where vapor of the solvent diffused in the first chamber is exhausted.

In this way, it is possible to promptly discharge the solvent vapor diffused in the first chamber because the control unit drives the introducing valve to introduce the inactive gas into the first chamber when the solvent vapor is exhausted. In case where the first chamber communicates with the second chamber, the pressure in the first chamber can be reduced to lower than the prescribed operational pressure. Accordingly, the fluctuation in the vapor pressure of the solvent remaining around the surface of the liquid can be reduced. Therefore, it is possible to provide the reduced-pressure drying apparatus in which the drying can be performed under the condition where the distribution of the vapor pressure of the solvent is uniform.

It is also preferable that a rectifying plate which rectifies a flow of the introduced inactive gas that flows from a side of the work to a side of the communicating part being provided in the first chamber.

In this way, the direction in which the inactive gas flows can be rectified to be directed from the work side to the communicating part side when the solvent vapor is exhausted with the inactive gas since the rectifying plate is provided. Consequently, the vapor can be evenly exhausted.

It is further preferable that an adjuster that adjusts a capacity ratio between the first chamber and the second chamber being provided. In this way, the capacity ratio between the first chamber and the second chamber can be adjusted according to the solvent evaporation amount which differs depending on the kinds of the liquid applied to the work. Accordingly, it is possible to securely diffuse the solvent vapor to the second chamber side.

Furthermore, the chamber may have a partition wall that divides the chamber into the first chamber and the second chamber, and the adjuster may be a transportation device that moves the partition wall so as to change the capacity ratio between the first chamber and the second chamber. Moreover, the second chamber may be divided into a plurality of rooms, each room communicates with other room through a communicating valve, and the adjuster may include the communicating valve and a controller that drives the communicating valve so as to change the number of the rooms in the second chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described. The embodiments here are exemplified by a reduced-pressure drying apparatus that is used to form alignment films which cover pixel electrodes on a pair of substrates composing a liquid crystal panel of a liquid crystal display device.

First Embodiment

Figure 1A:
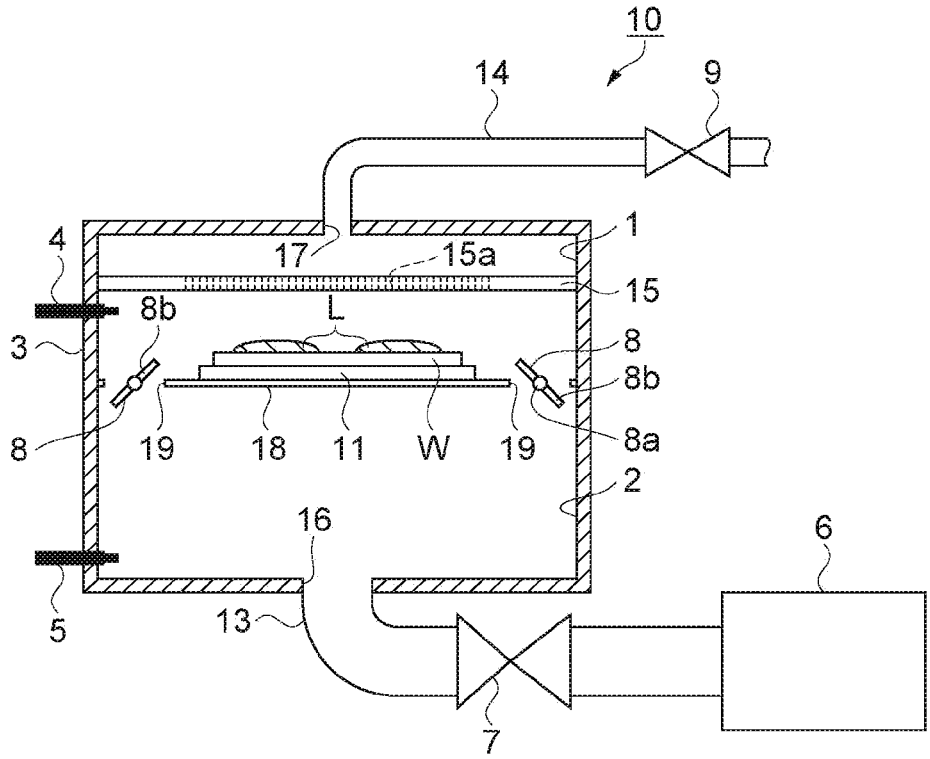
FIGS. 1A and 1B are schematic views showing a structure of a reduced-pressure drying apparatus according to a first embodiment of the invention.
Figure 1B:
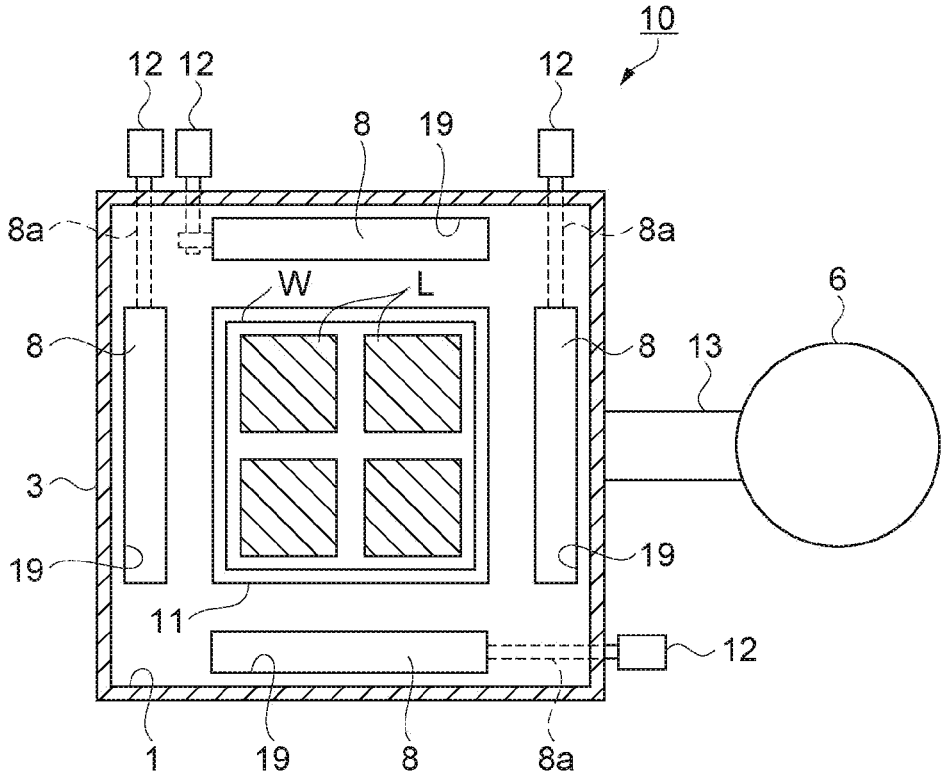

FIGS. 1A and 1B are schematic views showing a structure of a reduced-pressure drying apparatus according to a first embodiment of the invention. FIG. 1A is a perspective schematic view of the apparatus from the side to the inside of the apparatus. FIG. 1B is a perspective schematic view of the apparatus from the top side to the inside of the apparatus. As shown in FIG. 1A, a substrate W which is work to which liquid L is applied is provided in a chamber 3 of a reduced-pressure drying apparatus 10. The liquid L includes a film forming material that is an alignment film forming material in this embodiment. The reduced-pressure drying apparatus is equipment in which a solvent of the liquid L is evaporated and dried under a reduced pressure.

The chamber 3 includes a first chamber 1 which is illustrated in the upper side in FIG. 1A and a second chamber 2 which is illustrated in the lower side of the figure. A partition wall 18 divides the chamber 3 in such a way that the volume of the second chamber 2 becomes larger than that of the first chamber 1. A table 11 and a rectifying plate 15 are provided on the partition wall 18 in the side of the first chamber 1. The substrate W is placed on the table 11 and the rectifying plate 15 is provided so as to oppose the table 11 with a certain distance therebetween. A plurality of venting holes 15*a* is provided in the rectifying plate 15. The plurality of venting holes 15*a* is placed corresponding to the area of the substrate W and gas can passes through the venting holes.

A connecting hole 17 is provided in the up central region of the first chamber 1. The connecting hole is coupled to one end of a pipe 14 that introduces an inactive gas which is nitrogen ($N_2$) in this embodiment into the first chamber 1. The other end of the pipe 14 is coupled to a $N_2$ gas supply source (unshown in the figure) through a $N_2$ valve 9 which is an introducing valve. A vacuum gauge 4 is further provided on the side face of the first chamber 1. The vacuum gauge 4 is a pressure gauge for measuring a pressure reducing state in the first chamber 1. The vacuum gauge 4 is electrically coupled to a hereinafter described control unit 20 (see FIG. 2) and outputs a detection result or a pressure value.

A connecting hole 16 is provided in the lower (bottom) central part of the second chamber 2. One end of a pipe 13 is coupled to the connecting hole 16. The other end of the pipe 13 is coupled to a vacuum pump 6 through a vacuum valve 7. The vacuum pump 6 can decrease the pressure in the second chamber 2. As such vacuum pump 6, for example, a dry pump, a turbo-molecular pump and the like can be used. These pumps may be combined so as to make it possible to set an operational pressure that creates a desirable reduced pressure state. A vacuum gauge 5 is provided on the side face of the second chamber 2. The vacuum gauge 5 is a pressure gauge for measuring a pressure reducing state in the second chamber 2. The vacuum gauge 5 and the vacuum pump 6 are electrically coupled to the hereinafter described control unit 20 (see FIG. 2). The control unit 20 can detect the output (pressure value) of the vacuum gauge 5 and can control an exhaust velocity of the vacuum pump 6.

As shown in FIG. 1A and FIG. 1B, a communicating opening 19 that connects the first chamber 1 and the second chamber 2 in the chamber 3 is provided in the partition wall 18. Four communicating openings are provided along the edge of the table 11. A communicating valve 8 is provided in each of the four communicating openings 19. The communicating valve 8 includes a rotating shaft 8*a* coupled to a motor 12 that is attached on the outer face of the chamber 3. Four motors are provided in this embodiment. The communicating valve 8 works in such a way that a valve 8*b* coupled to the rotating shaft 8*a* opens and closes the corresponding communicating opening 19 when the motor is driven so as to rotate the rotating shaft 8*a*. When the communicating valve 8 closes the communicating opening 19, the first chamber 1 is tightly closed and separated from the second chamber 2. At the same time, the second chamber 2 is tightly closed and separated from the first chamber 1. The four motors 12 are electrically coupled to the control unit 20 (see FIG. 2) respectively. The control unit 20 can control each of the four motors 12 independently and controls the communicating valve 8 to be opened or closed.

When shut a door (unshown in the figure) of the reduced-pressure drying apparatus 10, close the chamber 3 tightly, open the communicating valve 8 and drive the vacuum pump 6, the pressure in the first chamber 1 and the second chamber 2 can be reduced. When the communicating valve 8 is closed to shut the communicating opening 19 and the vacuum pump 6 is driven, only the second chamber 2 can be depressurized.

Figure 2:
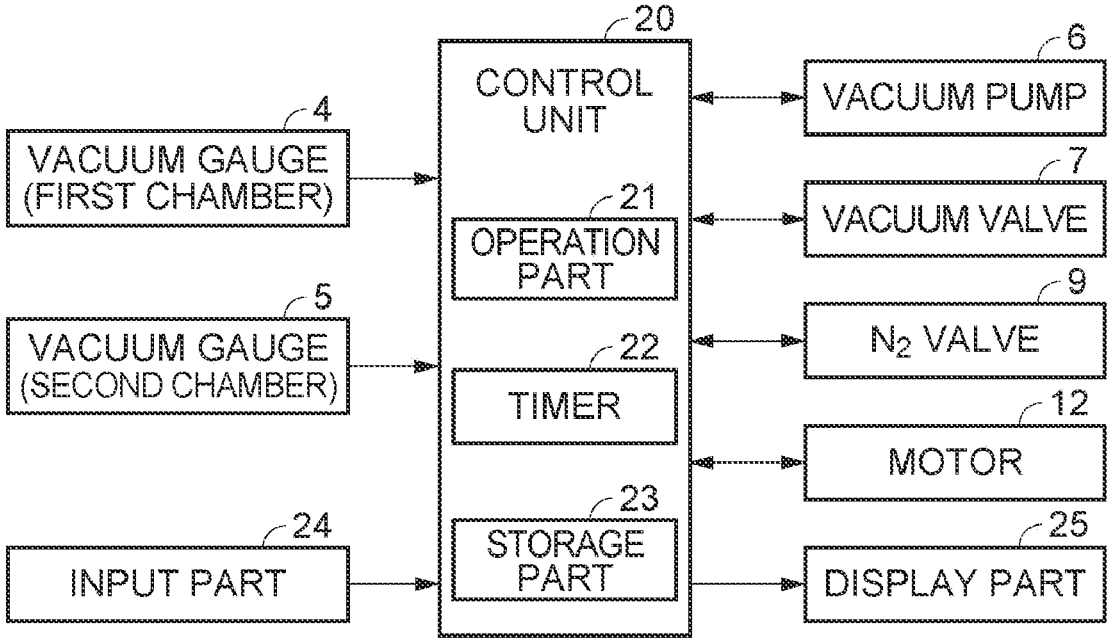
FIG. 2 is a block diagram showing an electrical or mechanical structure of the reduced-pressure drying apparatus according to the first embodiment.

FIG. 2 is a block diagram showing an electrical or mechanical structure of the reduced-pressure drying apparatus. As shown in FIG. 2, the reduced-pressure drying apparatus 10 has the control unit 20 including an operation part 21, a timer 22 and a storage part 23. The operation part 21 has a central processing unit (CPU), the timer 22 measures a time, and the storage part 23 stores data of the depressurizing and drying conditions such as depressurizing and drying profiles. The two vacuum gauges 4, 5 are electrically coupled to the control unit 20 so that the decompression states of the first chamber 1 and the second chamber 2 can be detected. The vacuum pump 6 is also coupled to the control unit 20 so that the control unit 20 can control the driving, the exhaust velocity and the like. The four motors 12 are also electrically coupled to the control unit 20 so that it can control the driving of the motors 12. The communicating valve 8 can be opened and closed by controlling the driving of the motor 12. Magnetic valves are used for the vacuum valve 7 and the $N_2$ valve 9. These Magnetic valves are electrically coupled to the control unit 20 and the control unit 20 can open or close these valves. Furthermore, an input part 24 and a display part 25 are also coupled to the control unit 20. The input part 24 has a drive device which is a storage medium that can send and receive data to/from a keyboard or a memory. The depressurizing and drying conditions such as depressurizing and drying profiles can be inputted through the input part 24 and they can be stored in the storage part 23. The display part 25 can display various input data, the pressure values of the first chamber 1 and the second chamber 2 which are detected by the vacuum gauges 4, 5, and operating conditions of the reduced-pressure drying apparatus 10. The operating conditions of the reduced-pressure drying apparatus 10 includes, for example, ON-OFF state of the apparatus, open-close states of the valves, elapsed time corresponding to each step in the depressurizing and drying process which is measured by the timer, and the like. The operation part 21 can calculate an evaporation amount of a solvent from data included in the depressurizing drying profiles stored in the storage part 23 and from the output (pressure values) of the vacuum gauges 4, 5. It is also possible to operate the depressurizing and drying process according to the set number of the depressurizing and drying operation which can be referred as a control operation included in the depressurizing and drying profiles.

Figure 3A:
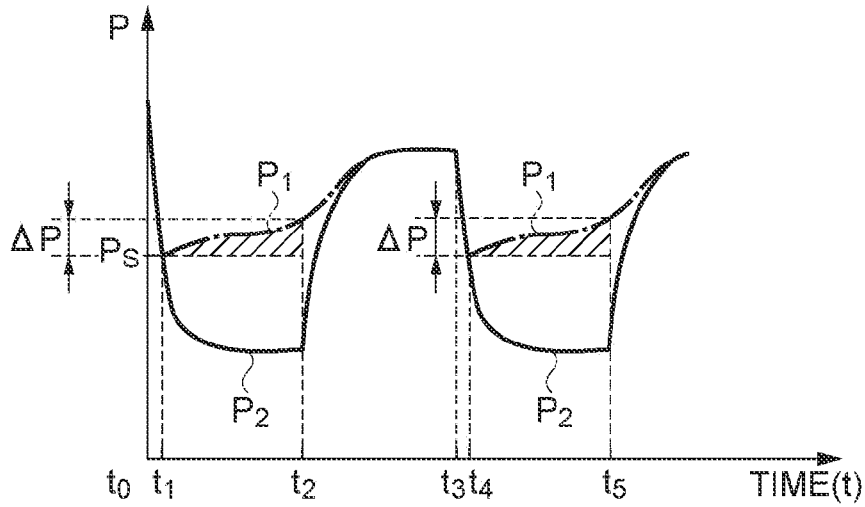
FIGS. 3A through 3C are graphs showing profiles of depressurizing and drying of the reduced-pressure drying apparatus.
Figure 3B:
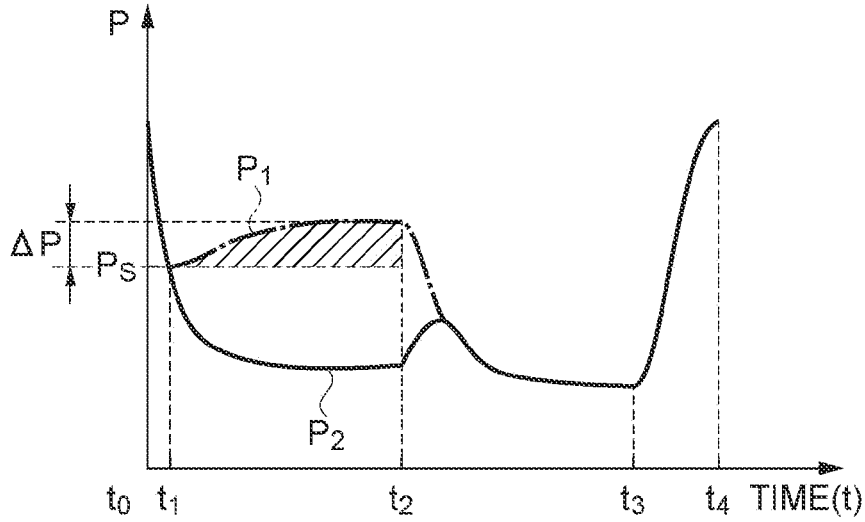
Figure 3C:
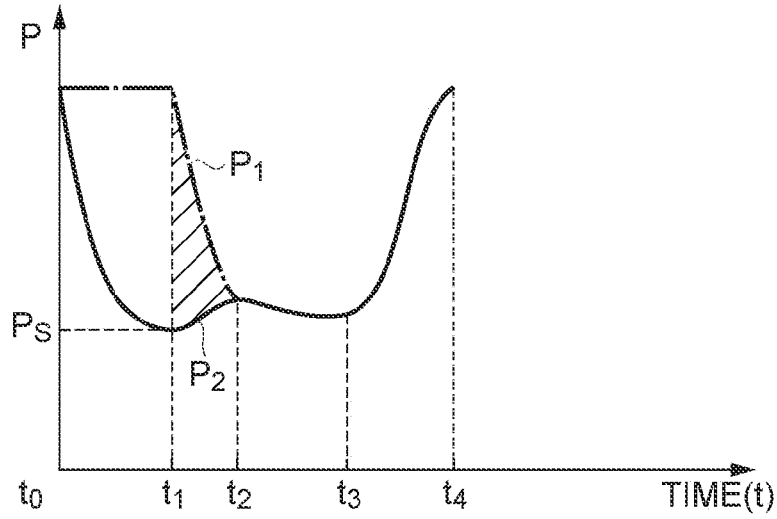

Next, operation of the reduced-pressure drying apparatus 10 is described based on the depressurizing and drying profiles. FIGS. 3A through 3C are graphs showing profiles of the depressurizing and drying of the reduced-pressure drying apparatus. More specifically, FIG. 3A is a graph showing a depressurizing and drying profile of an evaporation control type. FIG. 3B is a graph showing depressurizing and drying profile of a shape control type, and FIG. 3C shows a depressurizing and drying profile of a fast drying type. In the graphs, the pressure value is shown in logarithmic in the vertical scale.

Firstly, a detail of the liquid L including an alignment film forming material will be described before describing the above-mentioned depressurizing and drying profiles. The liquid crystal display panel of the liquid crystal display device has a pair of substrates having pixel electrodes and a liquid crystal which is an electrooptical material interposed between the pair of substrates. The liquid crystal consists of liquid crystal molecules that have electric moments according to its direction. As for a so-called field-effect type liquid crystal display panel, light entering the liquid crystal display panel (polarization) is controlled by changing an alignment direction of the liquid crystal molecules to a given electric field direction. An initial state of the alignment of the liquid crystal molecules is at when the electric field is not given between the opposing pixels.

In this case, an alignment film made of an organic thin film such as polyimide is formed on a substrate surface which faces the liquid crystal. A surface of the alignment film is rubbed in one direction and minuscule indented patterns are formed on the surface of the film. The liquid crystal molecules are provided so as to align along the pattern in one direction when there is no electric field. In this embodiment, the liquid L consists of polyimide resin which is the alignment film forming material and a solvent. The solvent is a mixture of organic solvents in a predetermined proportion. For example, γ-butyrolactone, ethylene glycol monobutyl ether and the like can be used for the solvent. As mentioned, the liquid L is a multi-element liquid and its physical property including the boiling point and the vapor pressure will differ depending on kinds of the adopted organic solvents. The boiling point of the γ-butyrolactone is 204° C. and the vapor pressure at 20° C. is 200 Pa. The boiling point of the ethylene glycol monobutyl ether is 170° C. and the vapor pressure at 20° C. is 80 Pa.

In such a case that the solvent in the liquid L applied on the substrate W is evaporated and dried in order to form the alignment film, if the surface of the dried alignment film is not flat and there is a difference in the film thickness, the thickness of the liquid crystal layer interposed, in other words, a gap between the pair of the substrates becomes uneven. This causes unevenness in color of the display and the alignment of the liquid crystal. Moreover, the polyimide resin itself is an insulating material and an electrical capacitance component is formed on the substrate surface. Accordingly, the unevenness in the film thickness leads to variation in the capacitance component and the drive voltage applied to the liquid crystal layer fluctuates, causing unevenness in display such as crosstalk. For this reason, it is preferable that the drying process is performed such that the surface of the dried alignment film becomes flat and the film thickness becomes even. The above-mentioned rheological properties differ depending on kinds of a solute and a solvent, ratio of the solute and the solvent contained in the liquid, and the like. Therefore, a depressurizing and drying profile that corresponds to the kind and the ratio of the solute and the solvent is required. A reduced-pressure drying apparatus that can accept various different depressurizing and drying profiles is also required. Operation of the reduced-pressure drying apparatus 10 corresponding to a depressurizing and drying profile will be now described.

Evaporation Control Type Depressurizing and Drying Profile

In the case of the evaporation control type depressurizing and drying profile as shown in FIG. 3A, the substrate W to which the liquid L is applied is placed on the table 11 in the first chamber 1. In this way, the substrate W is set in the chamber 3 and the door of the chamber is closed. The control unit 20 firstly checks whether the $N_2$ valve 9 is closed or not. If the $N_2$ valve 9 is closed, the control unit opens the four communicating valves 8 by driving the motors 12 and the first chamber 1 communicates with the second chamber 2 through the communicating opening 19.

The vacuum valve 7 is then opened, and the vacuum pump 6 is driven to start depressurizing (at time $t_0$). The four communicating valves 8 are closed by driving the motors 12 at a time $t_1$ when a pressure $P_1$ in the first chamber 1 and a pressure $P_2$ in the second chamber 2 reach a predetermined operational pressure $P_S$. This closes the communicating opening 19, tightly sealing the first chamber 1 in which the substrate W is placed. The control unit 20 closes the vacuum valve 7 when the pressure in the second chamber 2 is reduced to a pressure lower than the operational pressure $P_S$. The pressure $P_1$ in the first chamber 1 rises from the operational pressure $P_S$ as the solvent in the liquid L evaporates, which is shown as the dashed line in the graph. A pressure difference ΔP between the pressure $P_1$ and the operational pressure $P_S$ can be obtained by measuring the pressure $P_1$ with the vacuum gauge 4. The pressure difference ΔP is dependent on an evaporation amount of the solvent (the shaded area in the graph). Therefore, the evaporation amount (the amount of the molecules) can be derived from a gas state equation (PV=nRT) under the condition of a constant temperature, assuming that the evaporated solvent gas is ideal gas. The amount of the liquid applied to the substrate W and the capacity rate of the solvent in the liquid are give so that it is possible to calculate the evaporation amount of the solvent which is required to dry the applied liquid. Therefore, the evaporation amount in the reduced-pressure drying process can be controlled by setting ΔP. The desired amount of the solvent in the liquid L can be evaporated in the sealed first chamber 1 by setting ΔP which corresponds to the desired evaporation amount of the solvent and performing the depressurizing drying operation at least one time. In the above-described example, the desired amount of the solvent was a constant quantity given by dividing the total amount of the solvent contained in the liquid L by the number of the depressurizing operation. However, the desired amount of the solvent may be changed in the course of the repeated steps of the reduced-pressure drying.

Such calculation method of obtaining the evaporation amount is inputted through the input part 24 and stored as a program in the storage part 23 in advance. The operation part 21 executes the program stored in the storage part 23 and displays the calculated evaporation amount of the solvent to the display part 25 in conjunction with the transition of the pressure $P_1$.

When the pressure $P_1$ reaches the predetermined value, in other words, at a time $t_2$ when the vapor pressure of the sealed first chamber 1 in which a predetermined amount of the solvent evaporates reaches a predetermined value, the control unit 20 opens the communicating valve 8 by driving the motor 12. At the same time, the $N_2$ valve 9 is opened and $N_2$ gas is introduced into the first chamber 1. The entered $N_2$ gas passes through the venting holes 15*a* formed in the rectifying plate 15 and flows above the substrate W and to the communicating opening 19. In this way, the vapor of the solvent evaporated from the liquid L rides on the flow of the $N_2$ gas and flows toward the side of the second chamber 2. At the same time, the control unit 20 opens the vacuum valve 7 and drives the vacuum pump 6 to exhaust. The vacuum pump 6 is controlled such that its exhaust velocity is decreased according to the flow rate of the $N_2$ gas. When the $N_2$ gas is introduced while the first chamber 1 communicates with the second chamber 2, the reduced pressures in the first chamber 1 and the second chamber 2 are dissolved and the pressure in the chamber 3 rises higher than a prescribed pressure ($P_S$+ΔP). Accordingly, the evaporation of the liquid L is suppressed.

To exhaust the vapor of the solvent, the inactive gas of the $N_2$ gas is not necessarily introduced. The capacity of the second chamber 2 is larger than that of the first chamber 1 in the chamber 3 according to the embodiment. The solvent in the liquid L evaporates in the sealed first chamber 1 and the pressure $P_1$ becomes higher than the pressure $P_2$ in the second chamber 2. Unless the pressure $P_1$ becomes lower than the operational pressure $P_S$ when the first chamber 1 communicates with the second chamber 2 by opening the communicating valve 8, the vapor of the solvent that flowed into the second chamber 2 with a larger capacity and a smaller pressure can be diffused and exhausted. Alternatively, the vapor can be exhausted by sealing the first chamber 1 when the vapor of the solvent dispersed into the second chamber 2 and the pressure $P_1$ becomes equal to the pressure $P_2$. In this way, it is possible to minimum the effect of the exhaustion by the vacuum pump 6 and to reduce the evaporation of the solvent in the liquid L. Consequently, the vapor pressure can be maintained constant.

Next, the control unit 20 closes the $N_2$ valve 9 at a time $t_3$ when the pressure in the chamber 3 increases to the atmospheric pressure. The exhaust velocity of the vacuum pump 6 is increased and the pressure in the chamber 3 in which the first chamber 1 communicates with the second chamber 2 is reduced to the prescribed operational pressure $P_S$. The following operation is the same as the one described above, the communicating valve 8 is closed to seal the first chamber 1 at a time $t_4$ when the pressure reaches to the operational pressure $P_S$. The $N_2$ gas is introduced at a time $t_5$ when the pressure $P_1$ reaches the prescribed pressure ($P_S$+ΔP), and the vapor of the evaporated solvent is exhausted. In this way, the reduced pressure drying operation is performed. This depressurizing and drying operation during the time $t_0$ through $t_3$ is one round of the operation cycle and the control unit 20 repeats the cycle till the solvent of the liquid L completely evaporates. As the evaporation of the solvent advances, a time interval till which the pressure $P_1$ in the sealed first chamber 1 reaches the prescribed pressure ($P_S$+ΔP) becomes longer. Therefore, it is possible to determine when the drying finishes by observing the time interval.

The longer time interval in which the pressure $P_1$ in the sealed first chamber 1 reaches the prescribed pressure ($P_S$+ΔP) means that the evaporation rate of the solvent is decreased. In order to evaporate the solvent assuredly, a value of the operational pressure $P_S$ may be changed in the course of the repeated depressurizing and drying operation. For example, the value of the operational pressure $P_S$ may be made smaller than the previous value or step by step when the first chamber is sealed in the course of the depressurizing and drying operation, it is possible to prevent the evaporation rate of the solvent from decreasing. In other words, it is possible to promote the evaporation at a constant evaporation rate or an increased evaporation rate. To the contrary, if the first chamber 1 is closed when the value of the operational pressure $P_S$ is increased compared to the previous value or step by step, the evaporation rate can be decreased compared to the previous evaporation rate in the previous depressurizing and drying operation cycle. This means it is possible to promote the evaporation as the evaporation velocity is controlled. Therefore, if an accumulated evaporation amount N of the solvent calculated by the operation part 21 is equal to or more than 90% and less than 95% of the solvent amount M, for example, the depressurizing and drying profile may be changed at the depressurizing operation in such a way that the value of the operational pressure $P_S$ becomes lower that the previous value in order to make the accumulated evaporation amount N becomes more than 95% of the solvent amount M more sooner.

Next, how to set the value of ΔP in the depressurizing and drying operation is described. The operation part 21 can estimates the amount of the molecules of the evaporated solvent from the value of ΔP. Given the amount of the molecules of the evaporated solvent, it is possible to calculate the amount of the molecules of the solvent remaining in the liquid L. Therefore, it is possible to analyze how the ratio of the solute to the solvent in the liquid L transits according to the depressurizing and drying operation. The above-mentioned rheological properties differ depending on the ratio of the solute to the solvent. Therefore, an optimal value of the ΔP is preferably found out in order to reduce the deformation of the liquid L in the drying process. In order to find out the optimal value, tests in which the depressurizing and drying process is performed with different values of the ΔP are carried out in advance. The optimal value of the ΔP at which the unevenness in the film thickness becomes smallest and the film surface becomes flattest can be found by observing the film (the alignment film in this embodiment) geometry to which the test drying was performed. Such optimal value of the ΔP can be set according to the cycle of the reduced pressure drying operation.

Next, a prescribed value of the operational pressure $P_S$ is described. Even when the solvent consists of a single component, the solvent in the liquid L that is under a reduced pressure starts to evaporate before the reduced pressure reaches the vapor pressure (at 20° C.) of the solvent. Especially, in the case that the liquid L is a multi-element liquid like in this embodiment, a value of the reduced pressure at which the solvent starts to evaporate is expected to differ according to kinds of the organic solvents used and a mixture ratio thereof. To find out the pressure value at which the evaporation of the solvent starts and to know how the evaporation amount changes in the case of the multi-element liquid L, for example, the amount of the liquid L is measured with a weighing instrument (for example, an electric balance) that can weigh the mass of the liquid L and is provided in the chamber 3. The chamber 3 is depressurized at a constant rate by driving the vacuum pump 6, and the measurements are carried out. In this way, the relation between the pressure P detected by the vacuum gauge 5 and the weight of the liquid L measured by the weighing instrument can be found out.

Meanwhile, the solvent at which the pressure P is around the vapor pressure of the solvent evaporates fiercely and sometimes boils to bump. If the solvent comes to a sudden boil, the shape of the liquid L will be greatly distorted and the dried film will not become flat in section. Moreover, this sudden boil can occur anywhere in the surface of the substrate W on which the liquid L is applied, and the film thickness becomes uneven if it happens. In order to avoid such trouble, the first embodiment sets the operational pressure $P_S$, which determines specific reduced pressure values of the first chamber 1 and the second chamber 2, to a value which is higher than the vapor pressure of the solvent and lower than the pressure value at which the solvent starts to evaporate.

As described above, the reduced-pressure drying apparatus 10 make the first chamber 1 and the second chamber 2 communicate each other at the time $t_2$ when the pressure becomes the prescribed pressure ($P_S$+ΔP) where $P_S$ is the above-mentioned operational pressure, and repeats the depressurizing and drying operation which exhausts the vapor of the solvent. Consequently, it is possible to dry the liquid L under the reduced pressure while controlling the vapor amount corresponding to the pressure difference ΔP and controlling the evaporation rate.

Shape Control Type Depressurizing and Drying Profile

In the case of the shape control type depressurizing and drying profile as shown in FIG. 3B, the substrate W to which the liquid L is applied is placed on the table 11 in the first chamber 1. In this way, the substrate W is set in the chamber 3 and the door of the chamber is closed. In the same way as the above-mentioned profile case, the control unit 20 checks whether the $N_2$ valve 9 is closed or not. If the $N_2$ valve 9 is closed, the control unit opens the four communicating valves 8 by driving the motors 12 and then the first chamber 1 communicates with the second chamber 2 through the communicating opening 19.

Next, the vacuum valve 7 is opened, and the vacuum pump 6 is driven to start depressurizing (at a time $t_0$). The four communicating valves 8 are closed by driving the motors 12 at a time $t_1$ when the pressure $P_1$ in the first chamber 1 and the pressure $P_2$ in the second chamber 2 reach the prescribed operational pressure $P_S$. This closes the communicating opening 19, tightly sealing the first chamber 1 in which the substrate W is placed. The control unit 20 closes the vacuum valve 7 when the pressure in the second chamber 2. In this case, the operational pressure $P_S$ is set to the value at which most of the solvent in the liquid L evaporates and the viscosity of the liquid L increases to the degree just before it affects the film configuration.

Leave the apparatus as it is to the time $t_2$ when the pressure $P_1$ in the first chamber 1 reaches a predetermined pressure value. Here, the predetermined pressure value is the sum of the operational pressure $P_S$ and a saturated vapor pressure $P_{sa}$ of the solvent in the sealed first chamber 1. The saturated vapor pressure $P_{sa}$ of the solvent can be calculated since the volume of the first chamber 1 is known. In this way, the drying of the liquid L is carried out only by the diffusion of the vapor till it reaches the saturated vapor pressure so that the drying progresses very slowly. The sealed first chamber 1 is eventually filled with the vapor of the solvent and becomes saturated. The vapor pressure distribution in the substrate W plane gets balanced and becomes an equilibrium state. Consequently, the viscosity of the liquid L is increased, its shape is substantially fixed, and the film is made favorably even in the plane. In this case, the value of the pressure $P_1$ is not necessarily the exact figure of the sum of the operational pressure $P_S$ and the saturated vapor pressure $P_{sa}$. As long as the pressure is close to the saturated vapor pressure, the pressure distribution can be balanced. Furthermore, the saturated vapor pressure $P_{sa}$ may be compared to ΔP.

Next, the control unit 20 opens the communicating valve 8 by driving the motor 12. At the same time, the $N_2$ valve 9 is opened and $N_2$ gas is introduced into the first chamber 1. The vapor of the solvent (the evaporation amount accounts for the shaded portion in the figure) is exhausted by introducing the $N_2$ gas. The exhaustion is actively performed by increasing the exhaust velocity of the vacuum pump 6 so as to accommodate the exhaust velocity to the $N_2$ gas flow and so as to withdraw the solvent in the liquid L at once. Because the shape of the liquid L is substantially fixed, the active exhaustion will have little effect on the shape of the liquid in the reduced pressure drying process.

The active exhaustion keeps being performed till the time $t_3$ and then the vacuum pump 6 is stopped. The air is introduced into the chamber 3 and the pressure in the chamber is back to the atmospheric pressure. In this way, the depressurizing drying operation is ended (at a time $t_4$). It is preferable that the depressurizing drying operation being performed only once to dry the liquid. However, the amount of the liquid L differs depending on the area to which the liquid is applied. Therefore, the cycle of the depressurizing drying operation which is the processes performed in the period of the time $t_0$ through the time $t_4$ may be repeatedly performed in order to completely dry the liquid under a reduced pressure.

Fast drying type depressurizing and drying profile

In the case of the fast drying type depressurizing and drying profile as shown in FIG. 3C, the substrate W to which the liquid L is applied is placed on the table 11 in the first chamber 1. In this way, the substrate W is set in the chamber 3 and the door of the chamber is closed. The control unit 20 firstly checks whether the $N_2$ valve 9 is closed or not. If the $N_2$ valve 9 is closed, the control unit closes the four communicating valves 8 by driving the motors 12. Accordingly, the first chamber 1 does not communicate with the second chamber 2.

The vacuum valve 7 is then opened, and the vacuum pump 6 is driven to start depressurizing (at a time $t_0$). The four communicating valves 8 are opened by driving the motors 12 at a time $t_1$ when the pressure $P_2$ in the second chamber 2 reaches a prescribed operational pressure $P_S$. Accordingly, the sealed first chamber 1 communicates with the second chamber 2 where the pressure is reduced. The pressure $P_1$ in the first chamber 1 which is the atmospheric pressure is rapidly reduced to the value of the pressure $P_2$ in the second chamber 2. The vacuum pump 6 is kept driven in order to exhaust the vapor of the solvent evaporated from the liquid L (the amount of the vapor corresponds to the shaded area in the figure) while the pressure in the first chamber is decreasing. In this case, the prescribed operational pressure $P_S$ is set to the value which is higher than the vapor pressure of the solvent in the liquid L. This means that the sudden boil by the sudden depressurizing is not likely to occur.

In such fast drying type depressurizing drying profile case, the vapor pressure of the solvent becomes relatively higher than that of the other types of the depressurizing drying profile cases. This profile is adopted in such a case that most of the solvent should be evaporated in the course of the depressurizing process till the pressure reaches the prescribed operational pressure $P_S$. The liquid L in the first chamber 1 is placed in the reduced pressure which is sharply dropped to the prescribed operational pressure $P_S$ d. Therefore, it is possible to quickly fix the shape of the liquid if the solvent and solute are mixed in an appropriate ratio at which the shape of the liquid L is stabilized and the solvent is rapidly evaporate.

As described above, the reduced-pressure drying apparatus 10 can perform the reduced pressure drying processes corresponding to the above-mentioned three different profiles. More specifically, these three profiles are the evaporation control type profile in which the liquid L is dried as controlling the evaporation amount or the evaporation speed of the solvent as shown in FIG. 3A, the shape control type profile in which the drying is performed after the shape of the liquid L is stabilized as shown in FIG. B, and the fast drying type profile as shown in FIG. 3C. A reduced pressure drying which corresponds to these profiles combined may also be performed.

Advantages of the first embodiment are hereinafter described.

(1) The reduced-pressure drying apparatus 10 has the chamber 3 including the first chamber 1 and the second chamber 2, the vacuum pump 6 and the communicating valve 8. The substrate W to which the liquid L is applied is placed in the first chamber 1 and the liquid L is going to be dried under a reduced pressure. The vacuum pump 6 can reduced the pressure at least in the second chamber 2. The communicating opening 19 that communicates the first chamber 1 and the second chamber is opened and closed by the communicating valve 8. The reduced-pressure drying apparatus 10 also has the control unit 20 that controls the vacuum pump 6 to be driven and the communicating valve 8 to be opened or closed. The first chamber 1 is made communicate with the second chamber 2, the vacuum pump 6 is driven to reduce the pressure in the chamber to the prescribed operational pressure $P_S$, and then the communicating valve 8 is closed so as to seal the first chamber. After the solvent in the liquid L is evaporated till the pressure $P_1$ in the first chamber 1 reaches a predetermined pressure value, the communicating valve 8 is opened and the vapor is released to the outside. In this way, the reduced pressure drying operation which corresponds to the evaporation control type depressurizing drying profile is performed. In this case, it is possible to reduce the effects of the gas flow of the exhaustion by the vacuum pump 6 compared with the case in which the liquid L is dried under a reduced pressure made by a depressurizing means that keeps exhausting during the drying process. Moreover, the reduced pressure drying process can be carried out as the evaporation amount and the evaporation speed of the solvent are controlled. Meanwhile, if the solvent in the liquid L is evaporated till the pressure $P_1$ in the sealed first chamber 1 reaches the figure which is the sum of the operational pressure $P_S$ and the saturated vapor pressure $P_{sa}$ and the communicating valve 8 is then opened to exhaust the vapor, the reduced pressure drying operation corresponding to the shape control type depressurizing drying profile can be performed. In this case, the solvent can be slowly evaporated during the period from when the pressure reaches the operational pressure $P_S$ and to when the pressure reaches the saturated vapor pressure. The viscosity of the liquid L is sufficiently increased and the deformation is not likely to occur around at the operational pressure $P_S$. After the shape of the liquid L is fixed, the first chamber 1 is made communicate with the second chamber 2 and the vapor is actively exhausted so as to dry the remaining solvent. If the second chamber 2 is firstly depressurized to a prescribed operational pressure $P_S$ by operating the vacuum pump 6 while the first chamber 1 is sealed with the closed communicating valve 8, and then the first chamber 1 is made communicate with the second chamber 2 by opening the communicating valve 8, the liquid L is dried at once under a reduced pressure. In this way, the reduced pressure drying operation corresponding to the first dry type depressurizing drying profile can be performed. Consequently, it is possible to provide the reduced-pressure drying apparatus 10 compatible with the various depressurizing drying profiles corresponding to the rheological properties that vary depending on the kinds of the solute and the solvent used and the mixture ratio thereof.

(2) In the reduced-pressure drying apparatus 10 according to the first embodiment, the value which is higher than the vapor pressure of the solvent is given to the operational pressure $P_S$. Accordingly, the sudden boil caused by the extremely fast evaporation rate or the sudden evaporation can be prevented. Therefore, it is possible to dry the liquid L under a reduced pressure without affecting the shape of the liquid L.

(3) In the above-described reduced-pressure drying apparatus 10, the control unit 20 can repeat the depressurizing drying operation which is a control action. Consequently, it is possible to repeat the depressurizing drying operation corresponding to the applied amount of the liquid L and the liquid can be more securely dried.

(4) In the above-described reduced-pressure drying apparatus 10, the capacity of the second chamber 2 is larger than that of the first chamber 1. Accordingly, the vapor in the first chamber 1 where the pressure is high since the solvent is evaporated can be diffused in the second chamber 2 by connecting the first chamber 1 with the second chamber 2. The vapor is then exhausted with the vacuum pump 6.

(5) The above-described reduced-pressure drying apparatus 10 has the $N_2$ valve 9 with which an inactive gas such as $N_2$ gas can be introduced into the first chamber from the outside. The control unit 20 drives the $N_2$ valve 9 and introduce the $N_2$ gas to the first chamber when the vapor of the solvent in the first chamber 1 is exhausted. In this way, the vapor can be promptly discharged to the outside. At the same time, the evaporation of the remaining solvent in the liquid L is suppressed and this helps to maintain the vapor pressure distribution in the surface of the substrate W more uniform. In other words, it is possible to reduce the unevenness in the thickness of the dried film after the reduced pressure drying process. Moreover, since the $N_2$ gas is introduced when the vapor of the solvent is exhausted and the further evaporation of the solvent is prevented, the amount of the solvent evaporates can be controlled. Given $\Delta P$ as the vapor pressure of the certain amount of the solvent which is evaporated in the first chamber 1, the reduced pressure drying operation can be performed while controlling the evaporation amount of the solvent corresponding to $\Delta P$.

(6) In the above-described reduced-pressure drying apparatus 10, the rectifying plate 15 having the plurality of venting holes 15*a* is provided between the table 11 and the connecting hole 17 so as to oppose the table 11 in the first chamber 1. The substrate W is placed on the table 11 and the $N_2$ gas flows into the chamber through the connecting hole 17. The introduced $N_2$ gas is rectified with the rectifying plate 15 and the gas flow is made. Accordingly, the vapor of the solvent evaporated from the liquid L can be exhausted along the gas flow running in one direction toward the communicating opening 19. In this way, it is possible to reduce the unevenness in the dried film thickness caused by the irregularity in the vapor exhaustion. The first chamber 1 is provided above the second chamber 2 and the table 11 is provided on the side of the partition wall 18 which is closer to the first chamber 1. Accordingly, when the $N_2$ gas is introduced from the upper side of the first chamber 1, the gas creates the flow which pushes the substrate downward. Therefore, it is possible to prevent the trouble that the substrate W leaves from the table and floats in midair when the $N_2$ gas is introduced.

Second Embodiment

Figure 4A:
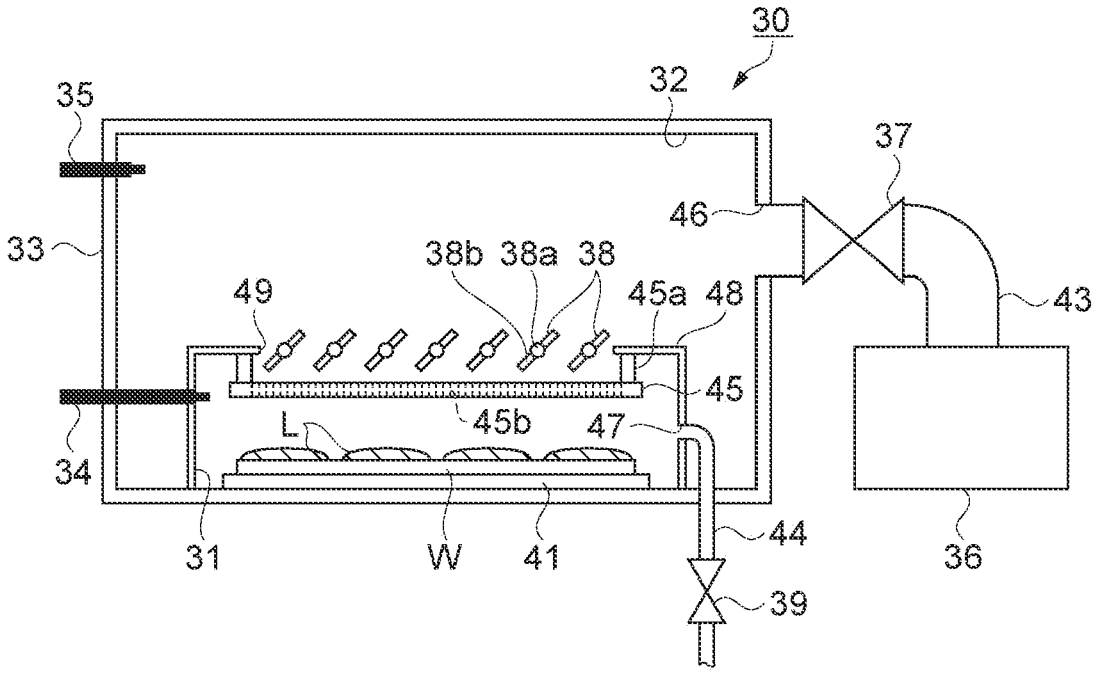
FIGS. 4A and 4B schematically show a structure of a reduced-pressure drying apparatus according to a second embodiment of the invention.
Figure 4B:
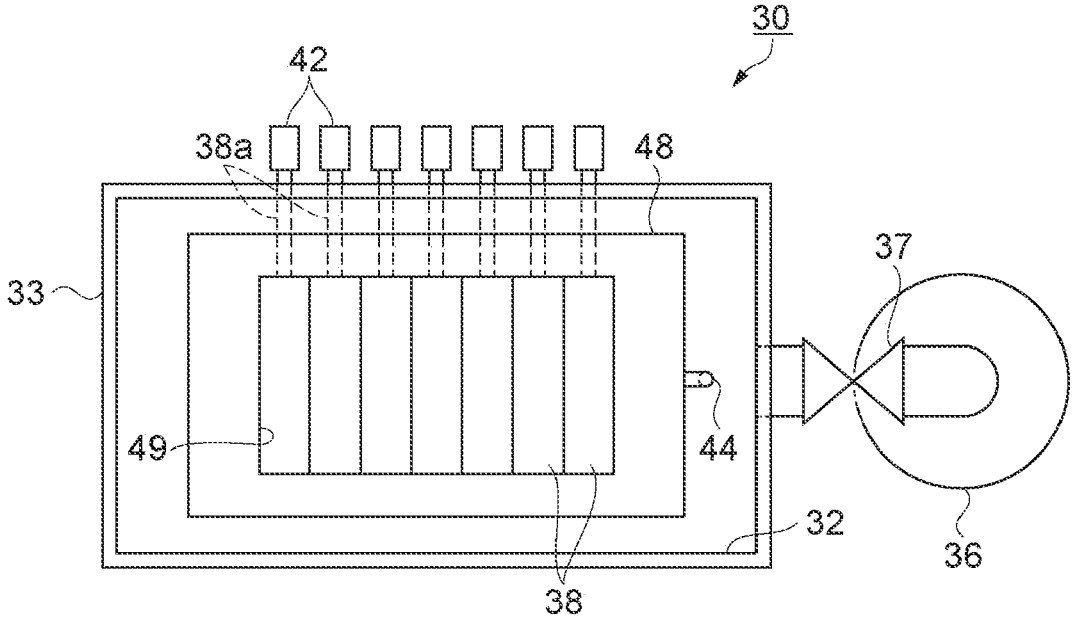

FIGS. 4A and 4B are schematic views showing a structure of a reduced-pressure drying apparatus according to a second embodiment of the invention. FIG. 4A is a perspective schematic view from the side to the inside of the apparatus. FIG. 4B is a perspective schematic view from the top side to the inside of the apparatus.

As shown in FIG. 4A, a reduced-pressure drying apparatus 30 has a chamber 33 and a vacuum pump 36. The chamber 33 includes a first chamber 31 and a second chamber 32 which is provided so as to surround the first chamber. The substrate W to which liquid L is applied is provided in the first chamber 31. The vacuum pump 36 can depressurize the second chamber 32.

The first chamber 31 is formed by parting the chamber 33 with a partition wall 48 which is provided in the bottom of the chamber 33 and has a box shape. A stage 41 on which the substrate W is placed is provided on the bottom of the first chamber 31. A communicating opening 49 whose size corresponds to the size of the substrate W and that connects the first chamber 31 with the second chamber 32 is provided in the upper face of the partition wall 48 which opposes the stage 41. A communicating valve 38 that can open and close the communicating opening 49 is provided in the plural number (here, seven valves) and arranged in line. A rectifying plate 45 that is supported by a post 45*a* that stands vertically from the peripheral of the communicating opening 49 to the stage 41 side is provided between the communicating opening 49 and the stage 41 so as to oppose the stage 41 with a certain distance therebetween. A plurality of venting holes 45*b* is provided in the rectifying plate 45. The plurality of venting holes 45*b* is placed corresponding to the area of the substrate W placed on the stage 41 and gas can passes through the venting holes. A connecting hole 47 is provided in the side face of the partition wall 48 that has the box shape. The connecting hole is coupled to one end of a pipe 44 that introduces an inactive gas which is nitrogen ($N_2$) in this embodiment into the first chamber 31. The other end of the pipe 44 is coupled to a $N_2$ gas supply source (unshown in the figure) through a $N_2$ valve 39 which is an introducing valve. A vacuum gauge 34 is further provided on the other side face of the first chamber 31. The vacuum gauge 34 can measure a reduced pressure value in the first chamber 31.

A connecting hole 46 is provided in the side wall of the second chamber 32. One end of a pipe 43 is coupled to the connecting hole 46. The other end of the pipe 43 is coupled to a vacuum pump 36 through a vacuum valve 37. The vacuum pump 6 can decrease the pressure in the second chamber 2. A vacuum gauge 35 is provided on the other side face of the second chamber 32. The vacuum gauge 5 is a pressure gauge for measuring a pressure reducing state in the second chamber 32.

As shown in FIG. 4A and FIG. 4B, a communicating opening 38 is provided in the plural number. Here, seven communicating openings 38 are provided. The communicating valve 38 can close the communicating opening 49 when a valve 38*b* coupled to a rotating shaft 38*a* rotates at a horizontal position. Each rotating shaft 38*a* is coupled to a motor 42 provided on the outer wall of the chamber 33.

The structure of the reduced-pressure drying apparatus 30 according to the second embodiment is essentially the same as that of the reduced-pressure drying apparatus 10 according to the first embodiment. The capacity of the second chamber 32 is larger than that of the first chamber 31 which is tightly closed. When the vapor of the solvent evaporated from the liquid L is exhausted, the $N_2$ gas is introduced from the side of the substrate W, which is different from the first embodiment. The $N_2$ gas containing the vapor is rectified when it passes through the venting holes 45*b* of the rectifying plate 45, the gas then flows into the second chamber 32 through seven opened communicating valves 38. The gas flowed into the second chamber is discharged outside through the connecting hole 46 by the vacuum pump 36. In other words, the vapor of the solvent evaporated from the liquid L is exhausted from above the substrate W, which is different from the first embodiment.

The mechanical and electrical configuration of the reduced-pressure drying apparatus 30 is the same as that of the reduced-pressure drying apparatus 10 according to the first embodiment as shown in the block diagram of FIG. 2, though different numerals are given to the corresponding parts and elements. Accordingly, the reduced-pressure drying apparatus 30 can perform the reduced-pressure drying operations corresponding to the depressurizing drying profiles shown in FIGS. 3A though 3C.

The above-described second embodiment has the following advantageous effect in addition to the same advantageous effects as those of the first embodiment which are described above in (1) through (5).

(1) In the reduced-pressure drying apparatus 30 according to the above-described second embodiment, the communicating opening 49 connecting the first chamber 31 and the second chamber 32 is provided in the top face of the partition wall 48 so as to oppose the table 41 with a certain distance therebetween. The substrate W to which the liquid L is applied is placed on the table 41. In this way, it is possible to provide the reduced-pressure drying apparatus 30 in which the vapor of the solvent evaporated from the whole area where the liquid L is applied can be smoothly diffused into the second chamber 32 and exhausted outside.

Third Embodiment

Figure 5:
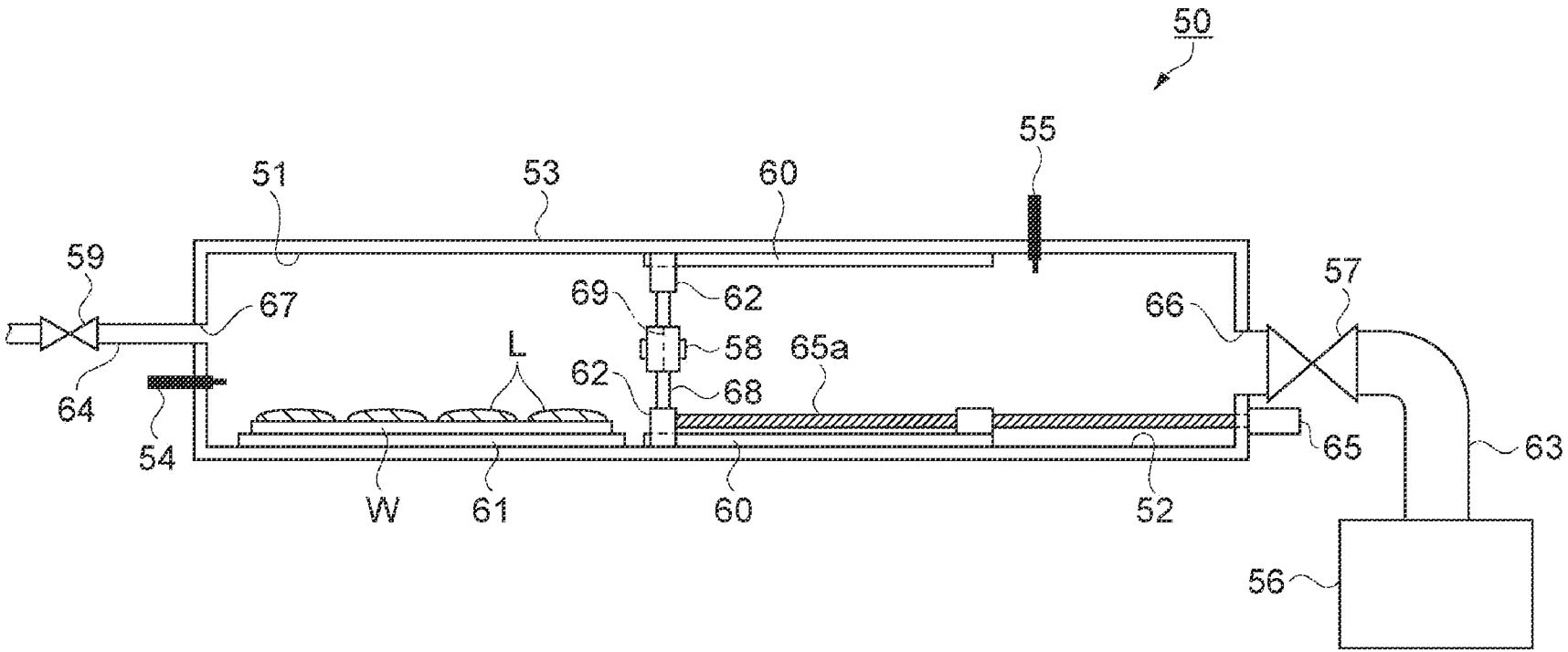
FIG. 5 schematically shows a structure of a reduced-pressure drying apparatus according to a third embodiment of the invention.

FIG. 5 is a schematic view showing a structure of a reduced-pressure drying apparatus according to a third embodiment of the invention. FIG. 5 is a perspective schematic view from the side to the inside of the apparatus.

As shown in FIG. 5, a reduced-pressure drying apparatus 50 according to the third embodiment has a chamber 53, a vacuum pump 56 and a partition wall 68. The chamber 3 includes a first chamber 51 in which the substrate W to which the liquid L is applied is placed and a second chamber 52. The vacuum pump 56 can decrease the pressure in the second chamber 52. The partition wall 68 divides the chamber 3 into the first chamber 51 and the second chamber 52. The partition wall 68 is movable along the inner wall of the chamber 53. A vacuum gauge 54 which measures a pressure reducing state in the first chamber 51 and a vacuum gauge 55 which measures a pressure reducing state in the second chamber 52 are also provided.

A table 61 on which the substrate W is placed is provided in the first chamber 51 on the bottom face. A connecting hole 67 is provided in the side wall of the first chamber 51. The connecting hole is coupled to one end of a pipe 64 that introduces an inactive gas which is nitrogen ($N_2$) in this embodiment into the first chamber 51. The other end of the pipe 64 is coupled to a $N_2$ gas supply source (unshown in the figure) through a $N_2$ valve 59 which is an introducing valve.

A connecting hole 66 is provided in the side wall of the second chamber 52. One end of a pipe 63 is coupled to the connecting hole 66. The other end of the pipe 63 is coupled to a vacuum pump 56 through a vacuum valve 57.

A pair of rails 60 is provided respectively in a center of the top and the bottom face in the chamber 53. Each rail has a slide member 62 and the partition wall 68 is supported between the pair of the rail members 62 placed at the top and the bottom in the chamber. The slide member 62 which is placed at the bottom face engages with a ball screw 65*a* that is provided in parallel with the rail 60. The ball screw 65*a* is rotated by a motor 65 installed in the outer face of the chamber 53. The slide member 62 that engages with the ball screw 65*a* can be moved by rotating the ball screw 65*a* with the motor 65. Accordingly, the partition wall 68 supported by the pair of the slide members 62 can be moved. In this case, the pair of the slide members 62 should have air tightness so that the first chamber 51 is air-tightly closed with the partition wall 68. To give the air tightness to the pair of the slide members, for example, a film made of a non-gas permeable material such as resin is provided so as to adhere to the inner wall of the first chamber 51 and the slide member 62. The film can be stretched according to the movement of the slide member 62.

A conductance valve 58 which is a communicating valve is provided in substantially the center of the partition wall 68. As the conductance valve 58, for example, a conductance variable valve in "Multi-Position Butterfly Valves MBV-MP series" manufactured by FUJI Technology Inc. can be used. In the case of this conductance variable valve, a butterfly valve is provided in a communicating part 69 in the valve. The butterfly valve opens and closes the communicating part 69 when it is driven by a servomotor. With the butterfly valve, it is possible to control how much the communicating part 69 opens.

The reduced-pressure drying apparatus 50 according to the third embodiment has essentially the same structure as that of the reduced-pressure drying apparatus 10 according to the first embodiment. The capacity of the first chamber 51 is variable by changing the position of the partition wall 68, which is different from the first embodiment. In this case, the capacity of the first chamber is variable within a range where the capacity of the second chamber 52 is larger than that of the first chamber 53.

Figure 6:
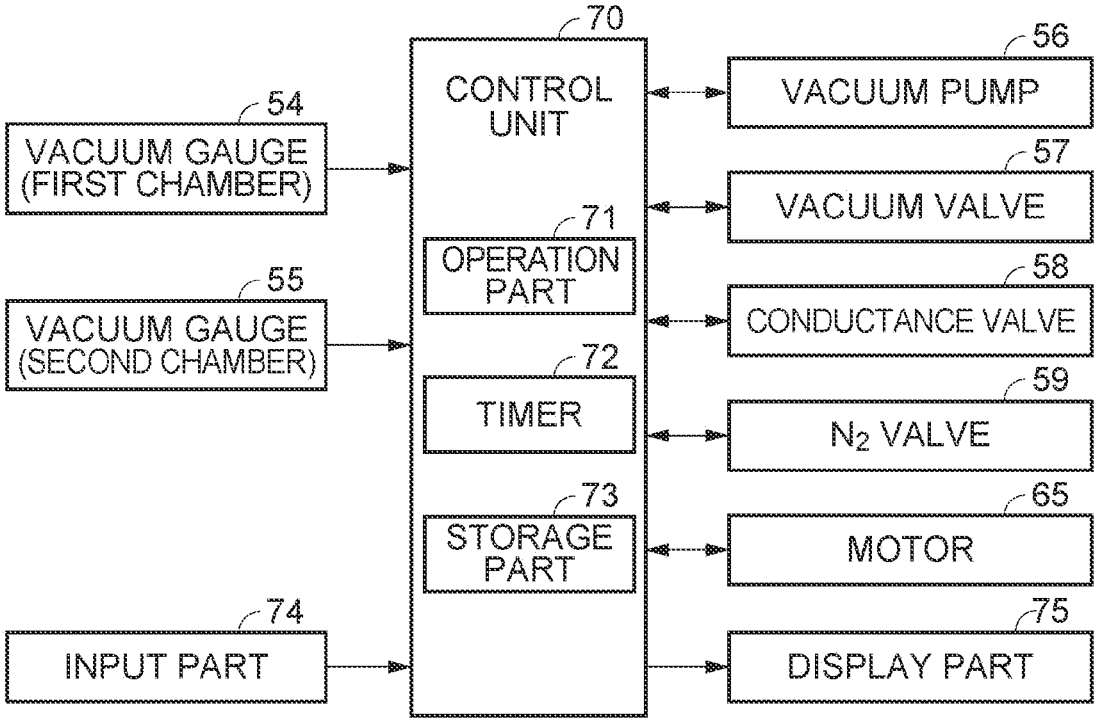
FIG. 6 is a block diagram showing an electrical or mechanical structure of the reduced-pressure drying apparatus according to the third embodiment.

FIG. 6 is a block diagram showing an electrical or mechanical structure of the reduced-pressure drying apparatus according to the third embodiment. As shown in FIG. 6, the reduced-pressure drying apparatus 50 has a control unit 70 including an operation part 71, a timer 72 and a storage part 73. The operation part 71 has a CPU, the timer 72 measures a time, and the storage part 73 stores data of the depressurizing and drying conditions such as the depressurizing drying profiles. The two vacuum gauges 54, 55 are electrically coupled to the control unit 70 so that the decompression states of the first chamber 51 and the second chamber 52 can be detected. The vacuum pump 56 and the conductance valve 58 are also electrically coupled to the control unit 70 so that the control unit 70 can control the driving of them. Magnetic valves are used for the vacuum valve 57 and the $N_2$ valve 59. These Magnetic valves are electrically coupled to the control unit 70 and the control unit 70 can open or close these valves. The motor 65 which is a transportation means is electrically coupled to the control unit 70 so that the control unit 70 can move the partition wall 68 by driving the motor 65. Furthermore, an input part 74 and a display part 75 are also electrically coupled to the control unit 70. The input part 74 has a keyboard (and a drive device which is a storage medium that can send and receive data). The depressurizing and drying conditions such as the depressurizing and drying profiles can be inputted through the input part 74 and they can be stored in the storage part 73. The display part 75 can display various input data, the pressure values of the first chamber 51 and the second chamber 52 which are detected by the vacuum gauges 54, 55, and operating conditions of the reduced-pressure drying apparatus 50. The operation part 71 can calculate an evaporation amount of a solvent from data included in the depressurizing drying profiles stored in the storage part 73 and from the pressure values detected by the vacuum gauges 54, 55. It is also possible to operate the depressurizing and drying process according to the number of the operation that should be repeated, which can be referred as a control operation included in the depressurizing and drying profiles.

As described above, the electrical or mechanical structure of the reduced-pressure drying apparatus 50 is the configuration in which the motor 65 is added to the configuration of the reduced-pressure drying apparatus 10 according to the first embodiment and the motor 12 driving the communicating valve 8 is replaced by the conductance valve 58. Therefore, the reduced-pressure drying apparatus 50 can also perform the reduced-pressure drying operations corresponding to the depressurizing drying profiles shown in FIGS. 3A though 3C. For example, in the case of the shape control type depressurizing drying profile shown in FIG. 3B, the control unit 70 firstly opens the conductance valve 58 and connects the first chamber 51 with the second chamber 52. The control unit 70 then opens the vacuum valve 57 and drives the vacuum pump 56, making the pressure in the chamber 53 a prescribed operational pressure $P_S$. Subsequently, the conductance valve 58 is closed and the first chamber 1 is air-tightly closed (at a time $t_1$). The apparatus is left as it is till a time $t_2$ when the pressure $P_1$ in the sealed first chamber 51 reaches the value which is the sum of the operational pressure $P_S$ and the saturated vapor pressure $P_{sa}$. The evaporation amount of the solvent under saturation is determined by the vapor pressure and the capacity of the first chamber 51. Therefore, the capacity of the first chamber 51 can be adjusted in advance by moving the position of the partition wall 68 according to the amount of the applied liquid L. Alternatively, the partition wall 68 may be moved to increase the capacity of the first chamber 1 when the vapor reaches the saturation point. In this way, the remaining solvent in the liquid L can be further evaporated.

The above-described third embodiment has the following advantageous effect in addition to the same advantageous effects as those of the first embodiment which are described above in (1) through (5).

(1) In the reduced-pressure drying apparatus 50 according to the above-described third embodiment, the partition wall 68 that divides the chamber 53 into the first chamber 51 and the second chamber 52 has the motor 65 which is the transportation means. Therefore, it is possible to change the capacity of the first chamber 51 while keeping its air tightness. Accordingly, it is possible to provide the reduced-pressure drying apparatus 50 that can create an appropriate saturation state in which most of the solvent in the sealed first chamber 51 is evaporated, particularly in the case of the shape control type depressurizing drying profile, by adjusting the capacity of the first chamber 51 according to the amount of the applied liquid L.

Forth Embodiment

Figure 7:
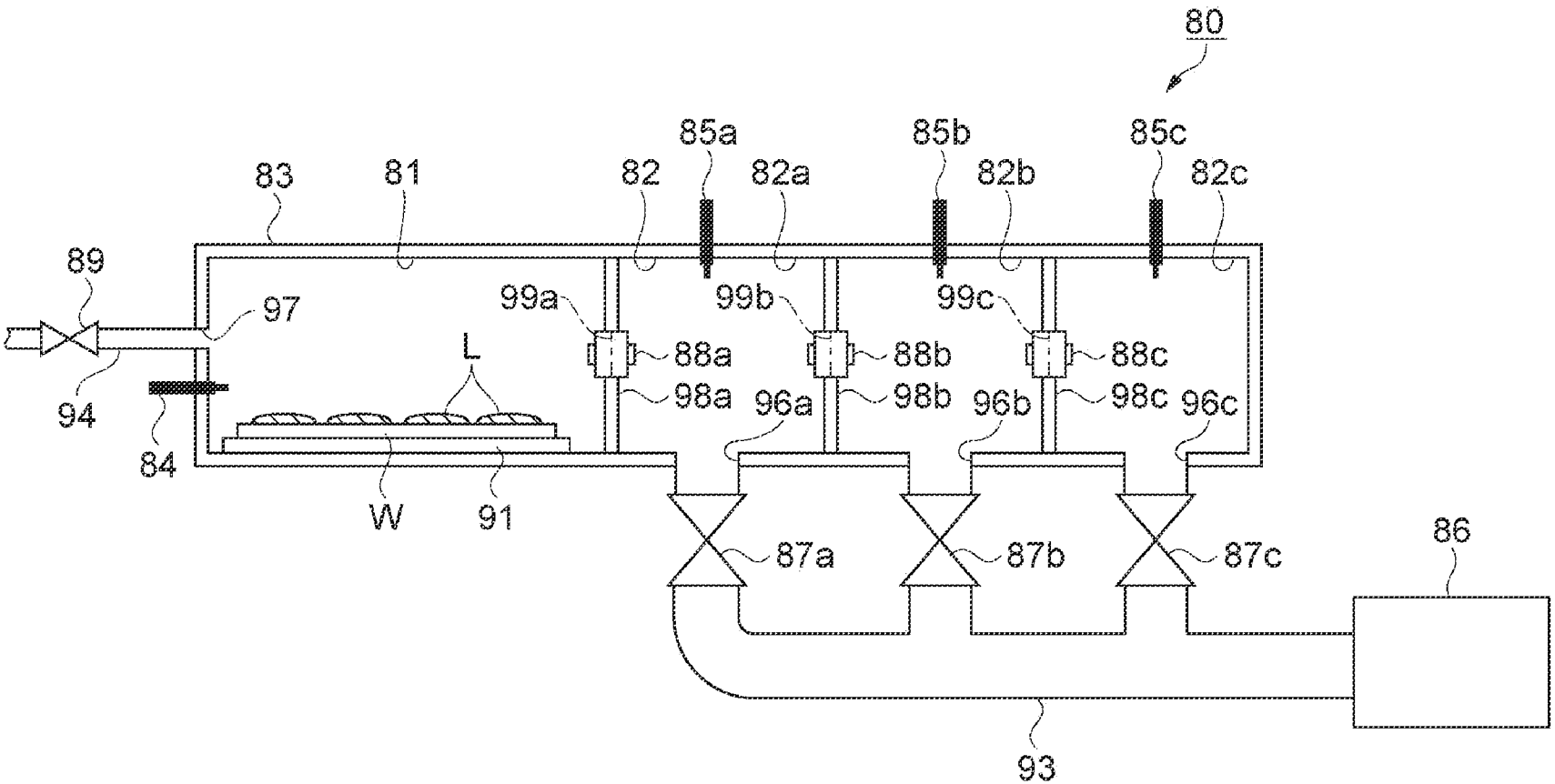
FIG. 7 schematically shows a structure of a reduced-pressure drying apparatus according to a fourth embodiment of the invention.

FIG. 7 is a schematic view showing a structure of a reduced-pressure drying apparatus according to a forth embodiment of the invention. FIG. 7 is a perspective schematic view from the side to the inside of the apparatus.

As shown in FIG. 7, a reduced-pressure drying apparatus 80 according to the forth embodiment has a chamber 83, a vacuum pump 86 and partition walls 98*a*, 98*b*, 98*c*. The chamber 83 includes a first chamber 81 in which the substrate W to which the liquid L is applied is placed and a second chamber 82 including a plurality of rooms (here, three rooms) 82*a*, 82*b*, 82*c*. The vacuum pump 86 can decrease the pressure in the rooms 82*a*, 82*b*, 82*c* in the second chamber 82. The partition walls 98*a*, 98*b*, 98*c* respectively divide the chamber 83 into the first chamber 81 and the rooms 82a, 82b, 82c. A vacuum gauge 84 which measures a pressure reducing state in the first chamber 81 and three vacuum gauges 85a, 85b, 85c which respectively measure a pressure reducing state in the rooms 82a, 82b, 82c are also provided.

A table 91 on which the substrate W is placed is provided on the bottom face of the first chamber 81. A connecting hole 97 is provided in the side wall of the first chamber 851. The connecting hole is coupled to one end of a pipe 94 that introduces an inactive gas which is nitrogen ($N_2$) in this embodiment into the first chamber 81. The other end of the pipe 94 is coupled to a $N_2$ gas supply source (unshown in the figure) through a $N_2$ valve 89 which is an introducing valve.

Connecting holes 96a, 96b, 96c are provided respectively in the bottom of the rooms 82a, 82b, 82c in the second chamber 82. One end of a pipe 93 which is separated into three portions is respectively coupled to the connecting holes 96a, 96b, 96c. The other end of the pipe 93 is coupled to a vacuum pump 86 through a vacuum valves 87a, 87b, 87c that are respectively provided in the three portions of the pipe 93.

Conductance valves 88a, 88b, 88c which are communicating valves whose conductance are variable in the same way as the one in the third embodiment are respectively provided in the center of the partition walls 98a, 98b, 98c. When all the conductance valves 88a, 88b, 88c are opened, the first chamber 81 can fully communicate with the second chamber 82 through communicating parts 99a, 99b, 99c. The capacity of the second chamber 82 communicating with the first chamber 81 can be changed by closing any of the conductance valves 88b, 88c. In this case, when the conductance valves 88a, 88c are closed and the conductance valve 88b is opened, the capacity of the second chamber 82 becomes larger than that of the first chamber 81.

Figure 8:
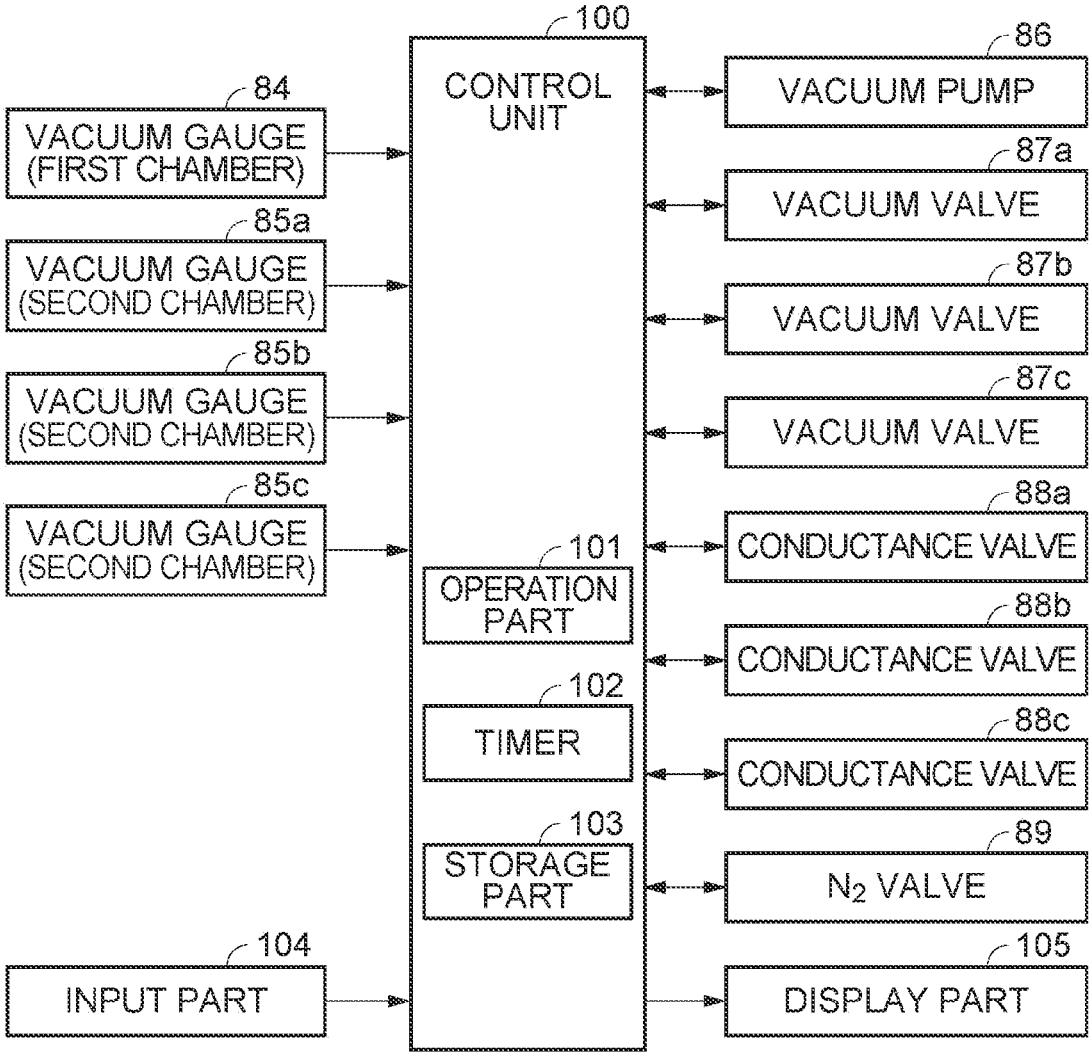
FIG. 8 is a block diagram showing an electrical or mechanical structure of the reduced-pressure drying apparatus according to the fourth embodiment.

FIG. 8 is a block diagram showing an electrical or mechanical structure of the reduced-pressure drying apparatus according to the forth embodiment. As shown in FIG. 8, the reduced-pressure drying apparatus 80 has a control unit 100 including an operation part 101, a timer 102 and a storage part 103. The operation part 101 has a CPU, the timer 102 measures a time, and the storage part 103 stores data of the depressurizing and drying conditions such as the depressurizing drying profiles. The four vacuum gauges 84, 85a, 85b, 85c are electrically coupled to the control unit 100 so that the decompression states of the first chamber 81 and the rooms 82a, 82b, 82c in the second chamber 82 can be detected. The vacuum pump 86 is also electrically coupled to the control unit 100 so that the control unit 100 can control the driving of the pump. Three conductance valves 88a, 88b, 88c are electrically coupled to the control unit 100 and the number of the rooms 82a, 82b, 82c that communicates with the first chamber 81 can be controlled by driving these three valves. Magnetic valves are used for the three vacuum valves 87a, 87b, 87c and the $N_2$ valve 89. These valves are also electrically coupled to the control unit 100 and their open and close are controlled. Furthermore, an input part 104 and a display part 105 are also electrically coupled to the control unit 100. The input part 104 has a keyboard (and a drive device which is a storage medium that can send and receive data). The depressurizing and drying conditions such as the depressurizing and drying profiles can be inputted through the input part 104 and they can be stored in the storage part 103. The display part 105 can display various input data, the pressure values of the first chamber 81 and the rooms 82a, 82b, 82c which are detected by the vacuum gauges 84, 85a, 85b, 85c and operating conditions of the reduced-pressure drying apparatus 80. The operation part 101 can calculate an evaporation amount of a solvent from data included in the depressurizing drying profiles stored in the storage part 103 and from the pressure values detected by the vacuum gauges 84, 85a, 85b, 85c. It is also possible to operate the depressurizing and drying process according to the number of the operation that should be repeated, which can be referred as a control operation included in the depressurizing and drying profiles.

As described above, the electrical or mechanical structure of the reduced-pressure drying apparatus 80 is the configuration in which more vacuum gauges and vacuum valves are added to the configuration of the reduced-pressure drying apparatus 10 according to the first embodiment and the motor 12 driving the communicating valve 8 is replaced by the conductance valves 88a, 88b, 88c. Therefore, the reduced-pressure drying apparatus 80 can also perform the reduced-pressure drying operations corresponding to the depressurizing drying profiles shown in FIGS. 3A though 3C. For example, in the case of the evaporation control type depressurizing drying profile shown in FIG. 3A, the control unit 100 firstly opens the conductance valves 88a, 88b and connects the first chamber 81 with the two rooms 82a, 82b. The control unit 100 then opens the vacuum valves 87a, 87b and drives the vacuum pump 86, making the pressure in the chamber 83 a prescribed operational pressure $P_S$. The conductance valve 88a is closed and the first chamber 81 is air-tightly sealed at a time $t_1$ when at least the first chamber 81 reaches the operational pressure $P_S$. The pressure $P_1$ rises since the solvent of the liquid L in the first chamber 81 evaporates. At a time $t_2$ when a certain pressure difference $\Delta P$ is generated, the $N_2$ valve 89 is opened and the $N_2$ gas is introduced into the first chamber 81. At the same time, the first chamber 81 is made communicate with the rooms 82a, 82b by opening the conductance valve 88a. This allows the $N_2$ gas containing the vapor of the solvent to diffuse into the rooms 82a, 82b and then the $N_2$ gas is exhausted by the vacuum pump 86. Subsequently, the pressure in the first chamber 81 and the rooms 82a, 82b is raised by introducing the $N_2$ gas and the depressurizing drying operation is repeated till a time $t_3$ when the pressure in the first chamber 81 and the rooms 82a, 82b become the pressure values which is substantially same as the initial values. As stated before, the evaporation rate of the solvent from the liquid L is decreased by repeating the depressurizing drying operation. This means that the evaporation amount per unit time may be decreased. However, with the reduced-pressure drying apparatus 80 according to the forth embodiment, the capacity of the second chamber 82 can be decreased corresponding to the decrease in the evaporation amount of the solvent in the course of the repeated depressurizing drying operation. For example, when the control unit 100 closes the valve 87b and the conductance valve 88b, the vapor of the evaporated solvent can be more promptly exhausted even if the exhaustion velocity of the vacuum pump 86 is constant. Moreover, it is possible to shorten a time interval which is required for the pressure to be reduced to the prescribed operational pressure $P_S$ again after one cycle of the depressurizing drying operation is finished. Accordingly, it is possible to carry out the drying of the liquid L more efficiently under a reduced pressure.

The above-described fourth embodiment has the following advantageous effect in addition to the same advantageous effects as those of the first embodiment which are described above in (1) through (5).

(1) In the reduced-pressure drying apparatus 80 according to the above-described fourth embodiment, the second chamber 82 has the plurality (three, in this embodiment) of the rooms 82a, 82b, 82c. The rooms 82a, 82b, 82c are respectively separated with the partition walls 98a, 98b, 98c that respectively have the conductance valves 88a, 88b, 88c.

Accordingly, the capacity of the second chamber 82 communicating the first chamber 81 in which the solvent is evaporated can be changed by opening or closing the conductance valves 88*a*, 88*b*, 88*c*. For example, in the case of the evaporation control type depressurizing drying profile, if the exhaustion velocity of the vacuum pump 86 is constant, the vapor of the evaporated solvent can be more rapidly exhausted by adjusting the capacity of the second chamber 82 according to the evaporation amount in the first chamber 81. Moreover, it is possible to shorten the time interval which is required for the pressure to be reduced to the prescribed operational pressure $P_S$ again after one cycle of the depressurizing drying operation is finished. Accordingly, it is possible to carry out the drying of the liquid L more efficiently under a reduced pressure.

Next, modification examples other than above-described embodiments are hereinafter described.

FIRST MODIFICATION EXAMPLE

The configurations of the first chamber and the second chamber is not limited to the one in the reduced-pressure drying apparatus 10 according to the first embodiment and in the reduced-pressure drying apparatus 30 according to the second embodiment. For example, two chambers are provided and one is used as the first chamber and the other is used as the second chamber. A communicating member that couples these two chambers is also provided. Furthermore, a gate which can open and close the communicating member is provided. In this way, the reduced-pressure drying apparatus that accepts the depressurizing drying profiles shown in FIGS. 3A though 3C can be configured.

SECOND MODIFICATION EXAMPLE

Though the reduced-pressure drying apparatus 10 in the first embodiment and the reduced-pressure drying apparatus 30 in the second embodiment have the rectifying plate in the first chamber, the rectifying plate is not necessarily required. The communicating valves 8, 38 respectively have the butterfly like valves 8*b*, 38*b*. If the rotating shafts 8*a*, 38*a* are rotated with a certain angle by driving the motors 12, 42, it is possible to rectify the gas flow with the valves 8*b*, 38*b*.

THIRD MODIFICATION EXAMPLE

The structure of the communicating openings 19, 49, and the communicating valves 8, 38 that open and close the communicating valves 8, 38 is not limited to the one in the reduced-pressure drying apparatus 10 according to the first embodiment and in the reduced-pressure drying apparatus 30 according to the second embodiment. Instead, the conductance valves can be used as described in the third and fourth embodiments. In this case, the exhaustion of the vapor in the first chamber 1, 31 and its vapor exhaustion velocity can be controlled with the conductance valve. In other words, it is possible to control the speed at which the solvent evaporates from the liquid L provided on the substrate W placed in the first chamber 1, 31.

FORTH MODIFICATION EXAMPLE

The transportation means to move the partition wall 68 is not limited to the one used in the reduced-pressure drying apparatus 30 according to the third embodiment. For example, an actuator such as an air cylinder can be used to move the position of the partition wall 68 instead of the motor 65. Furthermore, if the chamber 53 is made as a cylinder which is substantially air-tight and the partition wall 68 is made as a piston, it is possible to change the capacity of the first chamber 51 and the second chamber 52 by driving a connecting rod coupled to the piston.

FIFTH MODIFICATION EXAMPLE

The structure of the first chamber 1, 31, 51, 81 is not limited to the one in the reduced-pressure drying apparatus 10, 30, 50, 80 according to the first-fourth embodiments. For example, the table 11, 41, 61, 91 on which the substrate W is placed may have a heating means such as a heater. In this case, the evaporation of the solvent can be promoted in the reduced pressure drying process by heating the substrate W uniformly with the heating means. Consequently, it is possible to more rapidly fix the shape of the liquid L.

SIXTH MODIFICATION EXAMPLE

The subject which the reduced-pressure drying apparatus 10, 30, 50, 80 according to the first-fourth embodiments dries is not limited to the substrate W on which the liquid L is applied. For example, something having a round shape such as a semiconductor wafer and a lens of eyeglasses supported by a jig may be placed in the chamber and dried in the reduced-pressure drying apparatus.

SEVENTH MODIFICATION EXAMPLE

Though the work which was dried under a reduced pressure by the reduced-pressure drying apparatus 10, 30, 50, 80 according to the first-fourth embodiments was the substrate W to which the liquid L containing the alignment film forming material, the case is not limited to this. For example, the various liquid that contains a functional film forming material can be applied to the substrate W and dried by the reduced-pressure drying apparatus. Such functional film forming material includes, for example, a color element material for a color filter, a luminescence material such as organic electroluminescence, a conductive material for forming a circuit, an electron emissive element forming material and the like.

What is claimed is:

1. A reduced-pressure drying apparatus for drying a solvent in a liquid under a reduced pressure by evaporation of the solvent, comprising:

a chamber including a first chamber and a second chamber, the first chamber accommodating work to which a liquid containing a film forming material is applied, the second chamber being coupled to the first chamber through a communicating part;

a depressurizing unit depressurizing at least the second chamber;

a communicating valve opening and closing the communicating part;

a control unit controlling a reduced pressure state at least of the second chamber by driving the depressurizing unit, the control unit also controlling an opening and closing state of the communicating part by driving the communicating valve;

an introducing valve introducing an inactive gas at least into the first chamber from outside, wherein the control unit drives the introducing valve to introduce the inactive gas into the first chamber in the case where vapor of the solvent diffused in the first chamber is exhausted; and a rectifying plate provided in the first chamber, the rectifying plate having a plurality of venting holes for rectifying a flow of the introduced inactive gas from the work toward the communicating part.

2. The reduced-pressure drying apparatus according to claim 1, further comprising:

a pressure gauge measuring a reduced pressure state at least of the first chamber, wherein the control unit drives the communicating valve to communicate the first chamber with the second chamber, the control unit drives the depressurizing unit so that the first chamber and the second chamber are depressurized till a pressure value detected by the pressure gauge reaches a prescribed operational pressure, the control unit then drives the communicating valve to close the communicating part so that the first chamber is air-tightly closed, the control unit drives the communicating valve again to communicate the first chamber with the second chamber if the pressure value of the first chamber detected by the pressure gauge reaches a predetermined pressure value, and the control unit then drives the depressurizing unit to exhaust vapor of the solvent that is diffused in the first chamber and the second chamber.

3. The reduced-pressure drying apparatus according to claim 2, wherein the predetermined pressure value is a sum of the prescribed operational pressure and a vapor pressure at which a certain amount of the solvent is evaporated in the air-tightly closed first chamber, and the control unit make the depressurizing unit exhaust the vapor of the solvent diffused in the first chamber and the second chamber under a pressure whose value is larger than the predetermined pressure value.

4. The reduced-pressure drying apparatus according to claim 2, wherein a viscosity of the liquid is increased as the solvent evaporates from the liquid, the prescribed operational pressure is a pressure at which the viscosity of the liquid reaches just before a degree where the viscosity will affect a shape of the film, and the predetermined pressure value is a sum of the prescribed operational pressure and a saturated vapor pressure of the solvent evaporated in the air-tightly closed first chamber.

5. The reduced-pressure drying apparatus according to claim 2, wherein the control unit makes the depressurizing unit depressurize the second chamber that is separated from the first chamber to a pressure lower than the prescribed operational pressure before the control unit drives the communicating valve to communicate the first chamber with the second chamber and the vapor of the solvent diffused in the chamber is exhausted by the depressurizing unit.

6. The reduced-pressure drying apparatus according to claim 2, wherein the control unit repeats control operation that starts from depressurization of the first chamber and the second chamber by the depressurizing unit and ends at exhaustion of the solvent vapor diffused in the first chamber and the second chamber.

7. The reduced-pressure drying apparatus according to claim 1, further comprising:

a pressure gauge measuring a reduced pressure state at least of the second chamber, wherein the control unit drives the communicating valve to close the first chamber air-tightly, the control unit subsequently drives the depressurizing unit so that the air-tightly closed second chamber is depressurized till a pressure value detected by the pressure gauge reaches the prescribed operational pressure, the control unit then drives the communicating valve and releases the communicating part so as to communicate the first chamber with the second chamber, and the control unit makes the depressurizing unit exhaust vapor of the solvent diffused in the first chamber and the second chamber.

8. The reduced-pressure drying apparatus according to claim 2, wherein the prescribed operational pressure is higher than a vapor pressure of the solvent in the liquid.

9. The reduced-pressure drying apparatus according to claim 1, wherein a capacity of the second chamber is larger than a capacity of the first chamber.

10. The reduced-pressure drying apparatus according to claim 1, further comprising:

an adjuster adjusting a capacity ratio between the first chamber and the second chamber.

11. The reduced-pressure drying apparatus according to claim 10, wherein the chamber has a partition wall that divides the chamber into the first chamber and the second chamber, and the adjuster is a transportation device that moves the partition wall so as to change the capacity ratio between the first chamber and the second chamber.

12. The reduced-pressure drying apparatus according to claim 10, wherein the second chamber is divided into a plurality of rooms, each room communicates with other room through a communicating valve, and the adjuster includes the communicating valve and a controller that drives the communicating valve so as to change the number of the rooms in the second chamber.

* * * * *